US006296340B1

(12) United States Patent
Tajika et al.

(10) Patent No.: US 6,296,340 B1
(45) **Date of Patent: *Oct. 2, 2001**

(54) INK JET RECORDING METHOD AND APPARATUS USING TIME-SHARED INTERLACED RECORDING

(75) Inventors: Hiroshi Tajika; Masami Ikeda; Hiromitsu Hirabayashi, all of Yokohama; Jiro Moriyama, Kawasaki; Toshio Kashino, Chigasaki; Noribumi Koitabashi; Yuji Akiyama, both of Yokohama; Takeshi Okazaki, Sagamihara; Masaaki Izumida, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/923,526

(22) Filed: Sep. 4, 1997

Related U.S. Application Data

(63) Continuation of application No. 08/264,692, filed on Jun. 23, 1994, now abandoned.

(30) Foreign Application Priority Data

Jun. 23, 1993 (JP) ..... 5-152253
Jun. 13, 1994 (JP) ..... 6-130303

(51) Int. Cl.[7] ..... B41J 2/01

(52) U.S. Cl. ..... 347/12; 347/11; 347/60

(58) Field of Search ..... 347/10–12, 57, 347/60, 94, 180, 182, 15

(56) References Cited

U.S. PATENT DOCUMENTS

| | | | | |
|---|---|---|---|---|
| 4,087,825 | | 5/1978 | Chen et al. | 347/15 |
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,561,025 | * | 12/1985 | Tsuzuki | 358/298 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,172,134 | | 12/1992 | Shida et al. | 346/1.1 |
| 5,173,717 | | 12/1992 | Kishida et al. | 347/13 |
| 5,262,799 | * | 11/1993 | Ono et al. | 347/182 |
| 5,280,310 | | 1/1994 | Otsuka et al. | 347/12 |
| 5,452,095 | * | 9/1995 | Ono et al. | 358/296 |

FOREIGN PATENT DOCUMENTS

| | | |
|---|---|---|
| 4223707 | 1/1993 | (DE) . |
| 0440500 | 8/1991 | (EP) . |
| 0526223 | 2/1993 | (EP) . |
| 54-056847 | 5/1979 | (JP) . |
| 59-123670 | 7/1984 | (JP) . |
| 59-138461 | 8/1984 | (JP) . |
| 60-071260 | 4/1985 | (JP) . |

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

An ink jet recording method includes supplying a driving signal of a phase, wherein the driving signal comprising at least first and second signal periods with a rest period therebetween; and supplying a driving signal of a phase which is different to provide the first or second signal overlaps with the rest period of the driving signal having the first mentioned phase.

29 Claims, 33 Drawing Sheets

P1 : PRE HEAT (=T1) (PWM)
P2 : INTRVL (=T2 −T1)
P3 : MAIN HEAT PULSE (=T3 −T2)
Vop : DRV VOLT

FIG. 14(A)
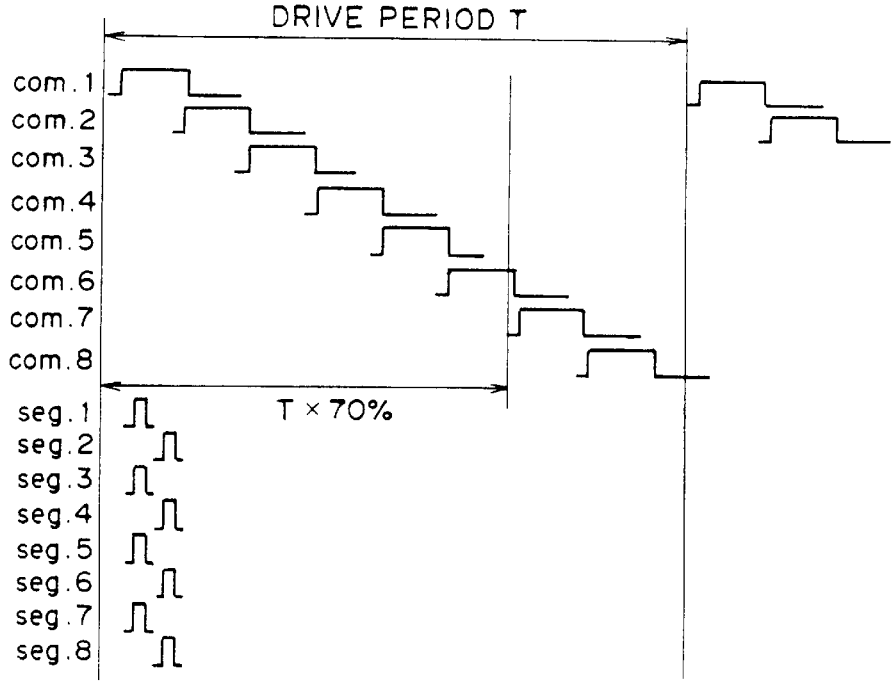
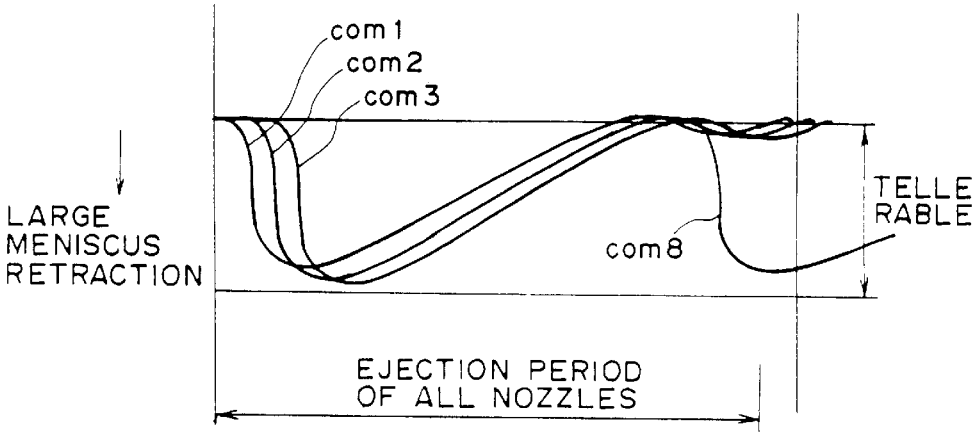
FIG. 14(B)

FIG. 22(B)
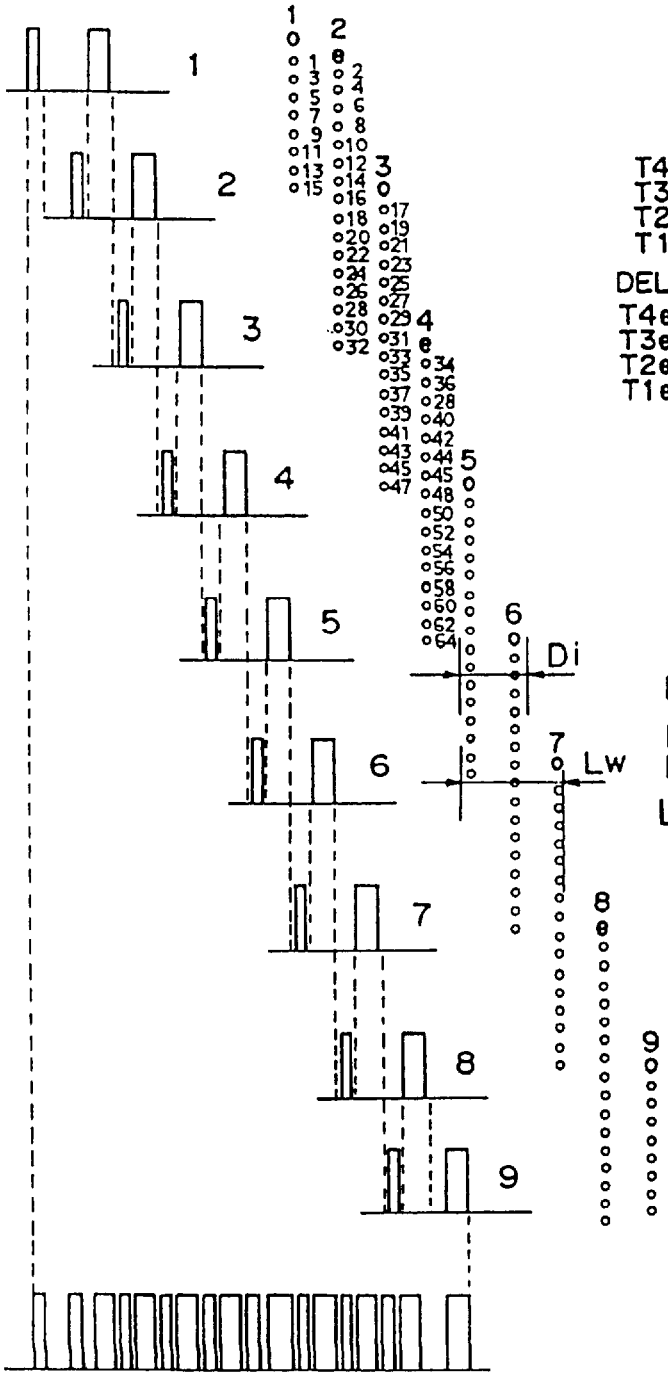
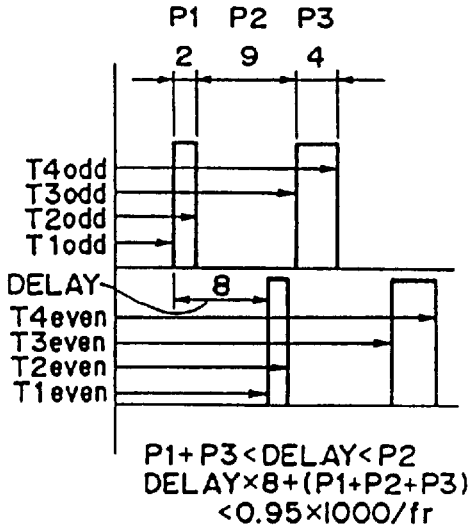
FIG. 22(C)
DELAY: Tseg 8 (μs)
LINE DEVIATION: Di 6.1 (μm)
LINE WIDTH: Lw 12.2 (μm)
FIG. 22(A)

FIG. 24(B)
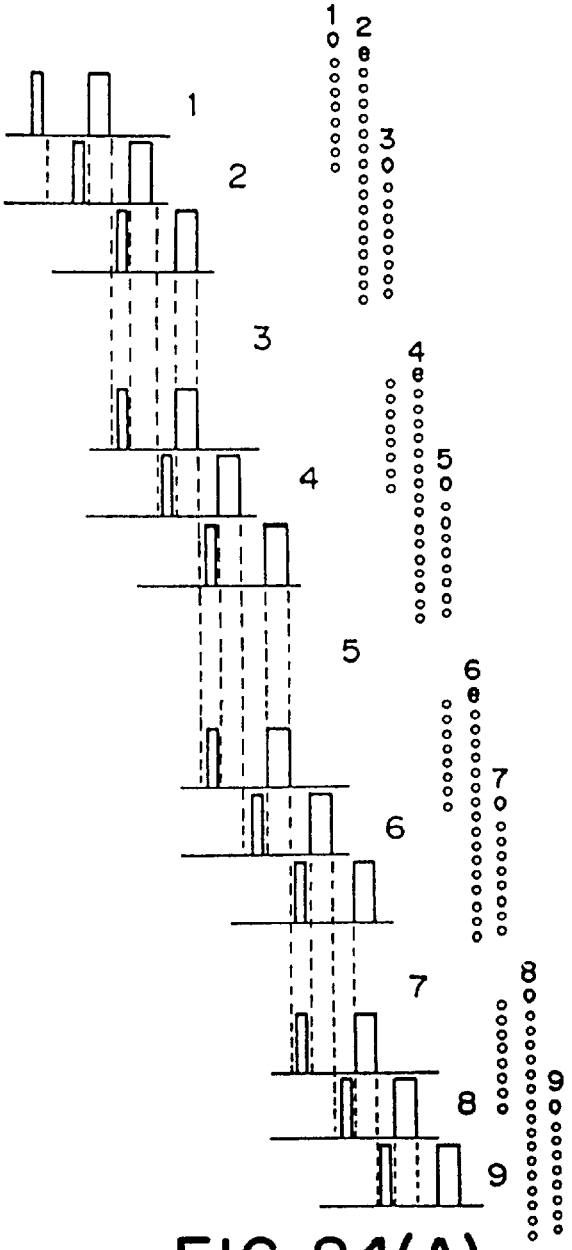
FIG. 24(A)
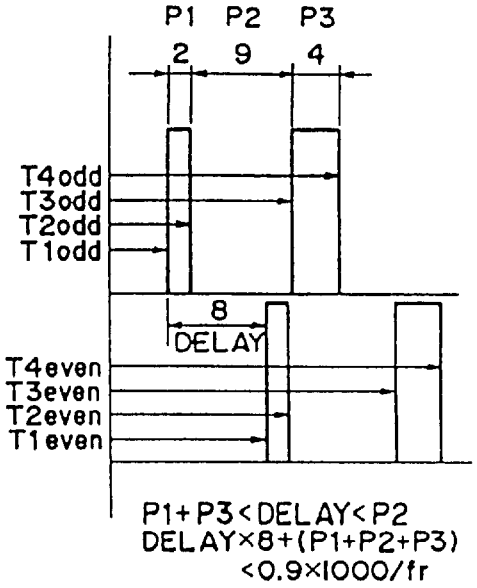
FIG. 24(C)
DELAY: Tseg 8 (μs)
LINE DEVIATION: DI 6.1 (μm)
LINE WIDTH: Lw 12.2 (μm)

FIG. 28(B)
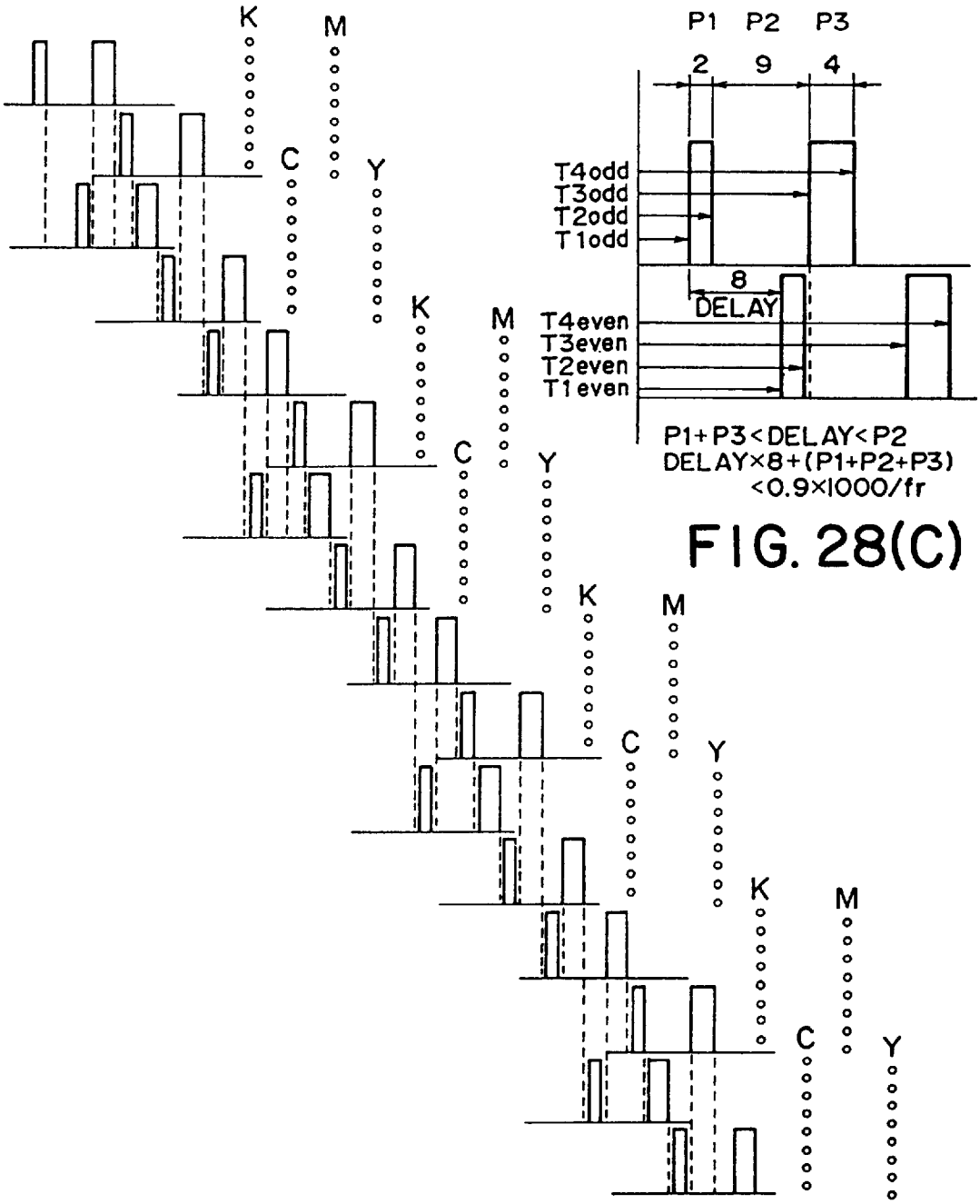
FIG. 28(C)
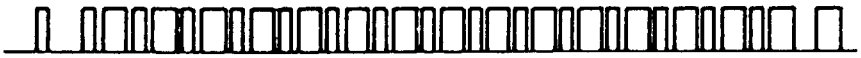
FIG. 28(A)

INK JET RECORDING METHOD AND APPARATUS USING TIME-SHARED INTERLACED RECORDING

This application is a continuation of application Ser. No. 08/264,692, filed Jun. 23, 1994, now abandoned.

FIELD OF THE INVENTION AND RELATED ART

The present invention relates to an ink jet recording method and apparatus in which ink is ejected from a recording head to a recording material to effect the recording.

In a recording apparatus such as a printer, copying machine, facsimile machine or the like, an image constituted by a dot pattern is recorded on a recording material such as paper or a thin sheet of plastic material in accordance with image information. The recording apparatus is classified depending on the recording system into an ink jet type, a wire dot type, a thermal type, a laser beam type and the like. Among them, the ink jet type (ink jet recording apparatus) is such that ink (recording liquid) droplets are ejected through ejection outlets of a recording head, to effect the recording by deposition of the ink on the recording material.

Recently, various types of recording apparatuses are used, and high speed recording, high resolution, high image quality, low noise or the like are desired for these recording apparatuses. To meet the requirement, the ink jet recording apparatus is suitable. Non-contact printing is possible because of ejecting the ink from the recording head, and therefore, very stabilized images can be printed.

However, it uses ink which is liquid, and therefore, if the recording head is driven at or near a critical printing speed, various hydromechanism inconveniences arise. In addition, since the ink is liquid, the physical states thereof such as viscosity or surface tension or the like change due to ambient temperature or the time period in which it is not used. For example, even if the printing is possible in an initial state, the printing may become difficult due to the increase of the vacuum due to the decrease of the ambient temperature and/or the decrease of the remaining quantity of the ink in the container, or the like.

In many prior art printers, a plurality of nozzles are all driven in as short of a period as possible so as to record a vertical line as a straight line. In most cases, several tens nozzles are grouped into blocks each containing several-16 nozzles approximately, and they are simultaneously driven to accomplish high speed operation. In this case, if the apparatus is driven near a critical ejection period, the refilling of the ink to the nozzle is not quick enough with the result that the next ejection starts before the ink is sufficiently refilled. If this occurs, improper ejection or extreme reduction of the ejected quantity, occur. Particularly when, a great number of nozzles are driven in short period of time (including simultaneous drive), a vacuum level in a common liquid chamber temporarily increases too much, with the result that the refilling is not quick enough. For example, the next ejection starts when the ink bulges out of the nozzle surface as a result of large vibration and the ink is splashed. Generally, this tends to occur near the maximum acceleration speed of the ink meniscus.

As a measure, as disclosed in U.S. Pat. Nos. 5,173,717, 5,280,310 or U.S. Ser. No. 859,332, the ink is prevented from simultaneously ejecting through adjacent ejection outlets by control. By doing so, the flexibility of the ink supply direction from the common chamber to the nozzles is increased so that the ink supply quantity to the nozzle inlets is simultaneously increased.

By the phase difference of the vibration in the adjacent nozzles, the refilling speed can be increased by the damping of vibration and the refilling speed can be increased by pulsewise motion. Particularly, the improvement in refilling the other nozzles by the ejection reaction pressure wave is significant.

As regards the improvements provided by the ejection reaction pressure wave, there are two significant factors. One of them is that the ink in the nozzle with which the ejection is going to complete, that is, the nozzle with which the ink therein is ejected but the maximum meniscus retraction has not been reached, is given a reaction pressure wave by driving another nozzle, preferably an adjacent nozzle, by which the inertia of retraction of the meniscus is attenuated before the maximum meniscus retraction is reached. By doing so, the required refilling distance is reduced, thus reducing the refilling time.

Another effect is that multiple ejection reaction pulses are imparted to the nozzle with which the refilling is in the process after the maximum meniscus retraction is reached, by which the refilling speed itself is increased. Hereinafter, this driving system is called offset drive.

As for the means for the offset drive, the drive timings are offset for every other dot, so that the even number nozzles and odd number nozzles are driven separately. Alternatively, the drive timings may be offset for every other two dots or another multiple of dots.

In the case of a printer for printing monochromatic or color images, various stabilities such as dot reproducibility, density stability, tone reproducibility, color reproducibility or the like, are desired, and are met by a drive control method.

Particularly in the case of a heating type ink jet recording apparatus, the ink ejection property (ejection quantity, ejection speed, bubble formation, refilling state or the like) varies due to the ambient temperature or due to the self-rise by the printing action. For the purpose of maintaining the stability or stabilities, an ejection amount control method using multiple pulses is proposed. In addition, an apparatus using a combination of the offset control and the ejection amount control, has been developed.

However, the conventional offset drive involves the following problems.

1. If the nozzle number N (block number (i) x segment number (j)) is increased, the number of nozzles J simultaneously driven is increased with the result of the influence of the voltage drop Vdrop or the influence of hydraulic cross-talk, are increased, such that a block open period Tb (open time period per 1 block) is reduced due to the increase of the number of groups (block number i). If the offset drive is simply carried out, the block open period becomes one half with the result of difficulty in assuring the control width of the ejection quantity.

2. By increasing further the drive frequency, the block open period monotonely decreases.

Therefore, if the above 1 and 2 are combined, the block open period extremely decreases with the result of difficulty in assuring the optimum control time period for the purpose of measurement against the hydraulic stroke. In addition, by the increase of the energy per unit type, the flexibility for the ejection amount control for absorbing temperature rise of the head by accumulation of generated heat is not maintained. More particularly, since the open period of the multiple pulses for each group of ejections becomes shorter, and therefore, the ejection amount variation (ejection amount control range) by the multiple pulse control is not assured.

SUMMARY OF THE INVENTION

Accordingly, it is a principal object of the present invention to provide an ink jet recording method and apparatus in which ejection amount control by the multiple pulse is assured to accomplish high speed and high quality image recording.

It is another object of the present invention to provide an ink jet recording method and apparatus in which multi-nozzle structure and high frequency drive are simultaneously accomplished.

It is a further object of the present invention to provide an ink jet recording method and apparatus capable of efficiently using an electric power source.

According to an aspect of the present invention, there is provided an ink jet recording method comprising: supplying a driving signal of a phase, wherein the driving signal comprising at least first and second signal periods with a rest period therebetween; and supplying a driving signal of a phase which is different to provide the first or second signal overlapping with the rest period of the driving signal having the first mentioned phase.

According to another aspect of the present invention, there is provided an ink jet recording method, comprising: grouping a plurality of nozzles into a plurality (i) of blocks of nozzles; supplying driving signals in a time-shared manner to the nozzles in the nozzle blocks, wherein the driving signal comprises a first signal period P1 and a second signal period P3 with a rest period P2 therebetween, for driving each of the nozzle blocks; wherein the first signal period P1 of the second blocks of nozzles is in the rest period P2 of the first block after the first signal period P1 of the first block, and wherein the second signal period P3 of the first block is in the rest period P2 of the second block, and wherein the first signal period P1 of the third block is in the rest period P2 of the second nozzle, and wherein the second signal period P3 of the second block is in the rest period P2 of the third block, and these operations are repeated up to the i-the block.

According to a further aspect of the present invention, there is provided an ink jet recording method in which a driving signal comprises at least first and second pulses with a rest period therebetween, and wherein the recording signals are supplied to ejection parts of a recording head in a time-shared manner, comprising: supplying a first pulse of a first driving signal; supplying the first pulse of a second driving signal in the rest period of the first driving signal; supplying the second pulse of the first driving signal in the rest period of the second drive signal, and thereafter, supplying the second pulse of the second driving signal.

According to a yet further aspect of the present invention, there is provided an ink jet recording apparatus comprising: independently drivable at least two groups of ejection parts; and driving signal supplying means for supplying to the first group and the second group, in a time-shared manner, a driving signal comprising at least first and second signal periods with a rest period therebetween, wherein the first signal period of the drive signal for the second group is in the rest period of the drive signal for the first group, and wherein the second signal period of the driving signal for the second group is in the rest period of the driving signal for the second group.

Thus, the drive signal period can be sufficiently assured. Even if the nozzle number is doubled, and the ejection frequency is substantially doubled as compared with the conventional ones, the offset drive using combination of even and odd numbers and the liquid cross-talk control (reduction of the maximum retraction of the refill and the increase of the refilling speed), can be carried out. In addition, the control using multiple pulses for the purpose of maintaining constant ejection properties can be accomplished (constant ejection amount and constant ejection speed against self rise of the temperature due to the printing and the temperature rise due to the ambient condition change). Therefore, the recording speed can be increased without reducing the conventional printing quality.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 14(A) illustrates drive periods according to the present invention.

FIG. 14(B) illustrates meniscus retraction according to the present invention.

FIGS. 22 (A), (C) illustrate drive waveforms of an interlace fine drive method in Embodiment 2.

FIG. 22(B) illustrates an alternating nozzle arrangement.

FIGS. 24(A), (C) illustrate drive waveforms illustrating driving order of the head in Embodiment 3.

FIG. 24(B) illustrates an alternating nozzle arrangement.

FIGS. 28(A), (C) illustrate color interval interlace drive according to a further embodiment of the present invention.

FIG. 28(B) illustrates an alternating nozzle arrangement.

DESCRIPTION OF THE PREFERRED EMBODIMENTS

Referring to the accompanying drawings, the description will be made as to Embodiments of an ink jet recording method and apparatus according to this invention.

Embodiment 1

Monochromatic printer, interlace drive

In this embodiment, the present invention is applied to a monochromatic printer having a recording head with 128 (16×8) nozzles, with the head drive frequency fop=6.6 Khz. The description will be made as to a method for accomplishing this.

FIGS. 1–5, illustrate an ink jet unit IJU, a ink jet head IJH, an ink container IT, an ink jet cartridge IJC, a main assembly of an ink jet recording apparatus IJRA, a carriage HC, and interrelationships therebetween. Referring to these Figures, the description will be made as to these parts.

(i) Main Assembly of the Apparatus

Figure 1:
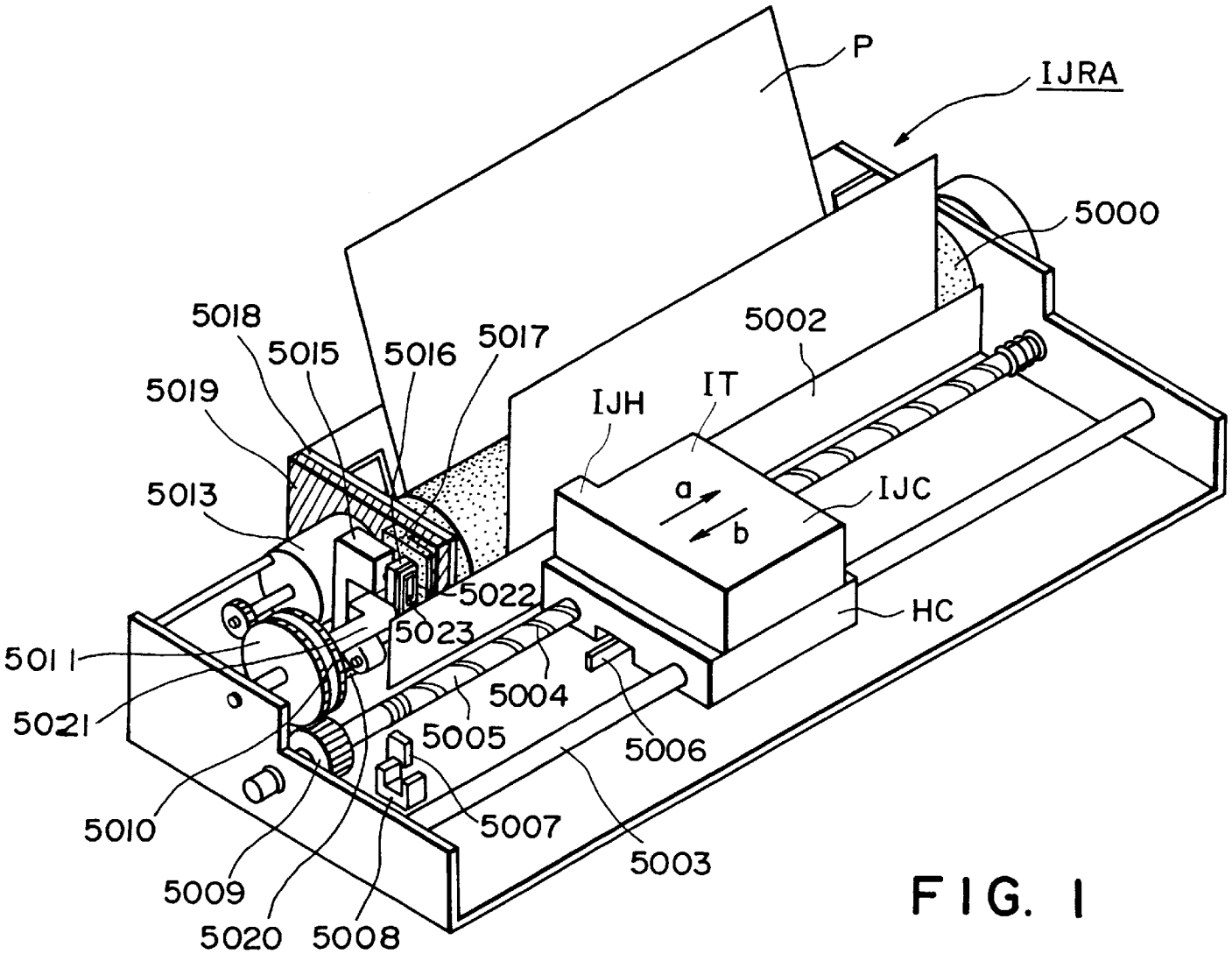
FIG. 1 is a schematic perspective view of an ink jet recording apparatus according to Embodiment 1 of the present invention.

FIG. 1 shows an outer appearance of an exemplary ink jet recording apparatus IJRA usable with the present invention. A lead screw 5005 is rotated through drive transmission gears 5011 and 5009 in response to forward and backward rotations of a driving motor 5013. The lead screw 5005 is provided with a helical group 5004, which is engaged with a pin (not shown) of a carriage HC. Therefore, the carriage HC is reciprocated in the directions of arrows a and b. An ink jet cartridge IJC is mounted on the carriage HC. Designated by a reference numeral 5002 is a sheet confining plate to press the sheet to a platen 5000 over a carriage moving range. A photocoupler constituted by elements 5007 and 5008 detects presence of a lever 5006 of the carriage, and in response to the detection, the rotation direction of the motor 5013 is switched. The photocoupler constitutes a home position detecting means. A supporting member 5016 supports a cap member 5022 for capping a front side of the recording head. A sucking means 5015 sucks the inside of the cap for effecting sucking recovery of the recording head through an opening 5023 in the cap. Designated by 5017 is a cleaning blade, and it is moved toward front and rear by a member 5019. They are supported on a frame 5018. The blade may be any other known cleaning blade.

A lever 5012 is used to start sucking of the sucking recovery operation, and is moved together with movement of a cam 5020 engaged with the carriage, and the driving force from the driving motor is controlled through known transmitting means such as clutch or the like.

The capping, cleaning and sucking recovery operations are carried out at the position or positions faced to these means by the function of the lead screw 5005 when the carriage is in the region of the home position. This embodiment is not limited to this, but may be used if the operations are carried out at known timings.

In the ink jet cartridge JIC of this embodiment, the ink accommodating portion has a relatively large ink containing portion, and an end portion of the ink jet unit IJU is slightly projected beyond front surface of the ink container IT. The ink jet cartridge IJC is supported and fixed on the carriage HC in the main assembly of the ink jet recording apparatus IJRA by positioning means and electrical contacts, but is detachable from the carriage.

(ii) Ink Jet unit IJU

The ink jet unit IJU effects the recording using electrothermal transducers for generating thermal energy for producing film boiling of the ink in accordance with an electric signal.

(iii) Heater Board

Figure 2:
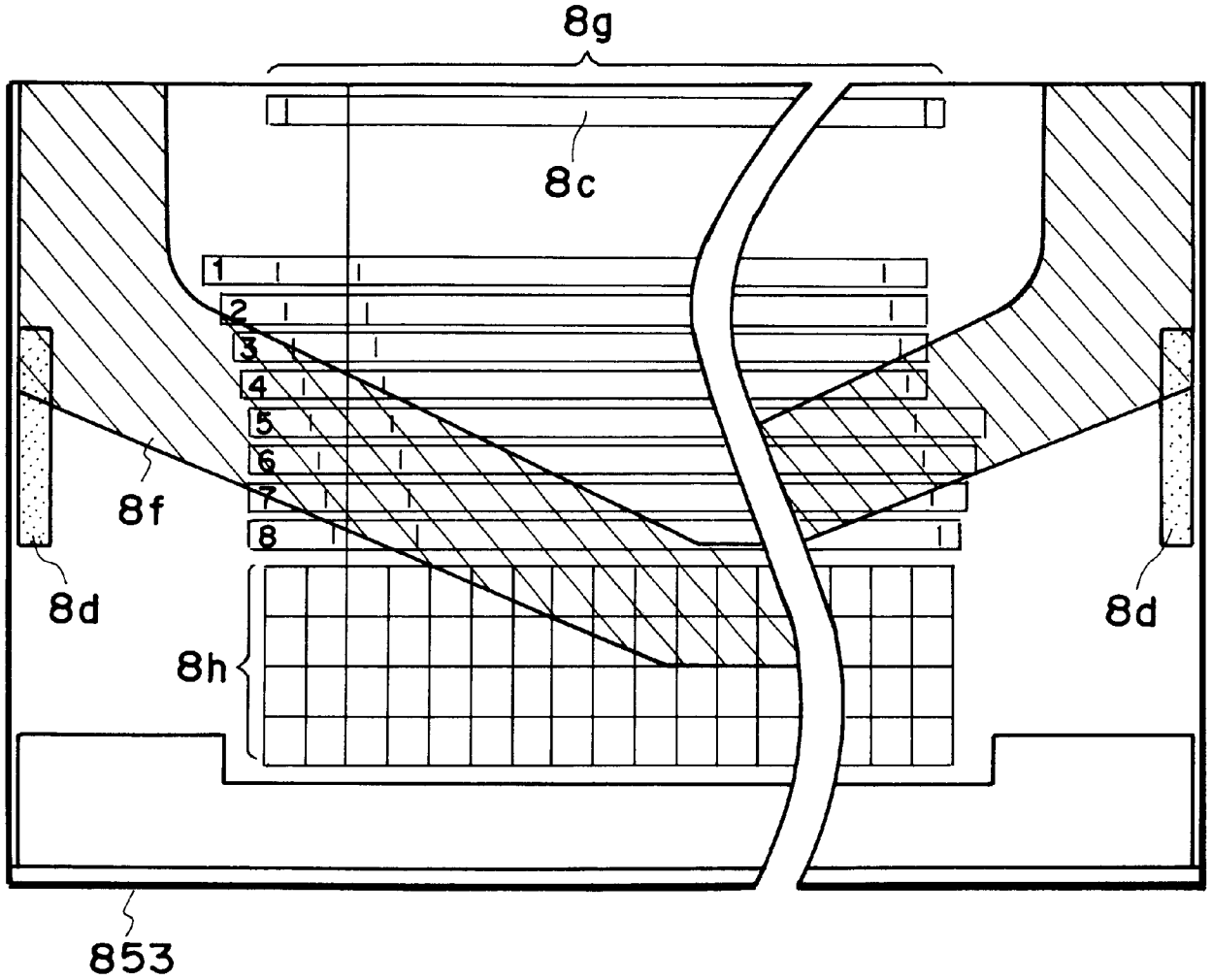
FIG. 2 is a schematic view of a heater board of a recording head used in Embodiment 1.

FIG. 2 is a schematic view of a heater board 100 of the recording head used in this embodiment. It comprises a substrate on which a (sub) heater 8*d* for controlling the temperature of the head, an array 8*g* of ejection parts having ejection (main) heaters 8*c* for ejecting the ink, and driving elements 8*h* are formed in the positional relationship shown in this Figure. By forming the various elements on the same substrate, the head temperature is efficiently detected and controlled, and in addition, the size of the head can be decreased, and the manufacturing steps can be simplified. The same Figure shows a positional relationship of a cross-section 8*f* of an outer peripheral wall of the top plate for separation between a region filled with the ink and a region not filled with the ink. The ejection heater 8*d* side of the outer peripheral wall section 8*f* functions as a common liquid chamber. Liquid passages are formed by grooves formed on the array 8*g* of the surface 8*f* of the top plate.

(iv) Control System

Figure 3:
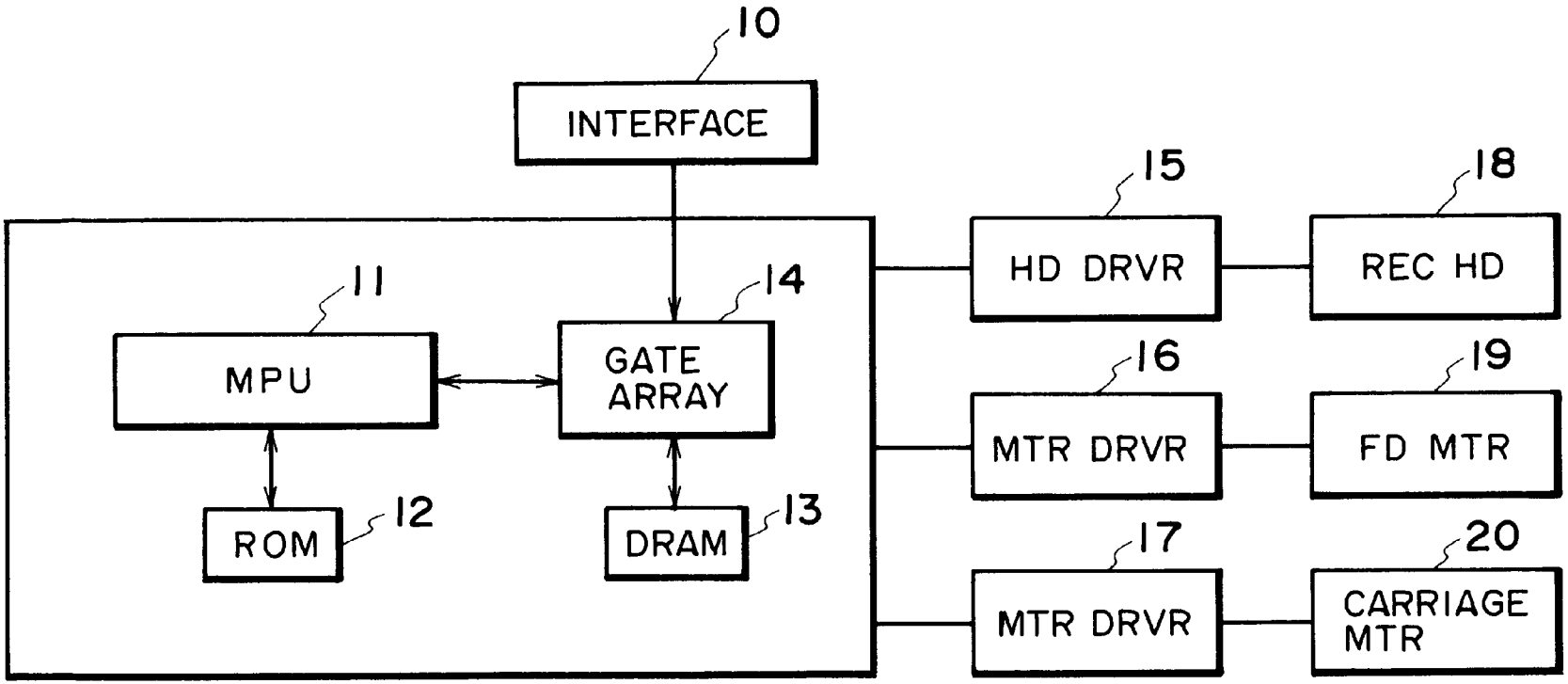
FIG. 3 is a block diagram of a control system used in Embodiment 1.

Referring to a block diagram of FIG. 3, the description will be made as to a control system for carrying out a recording control operation for various parts of the apparatus.

Upon supply of a print signal to an interface 100, the signal is converted to a signal for the printing between a gate array 104 and MPU 101, and a motor driver 106 or motor driver 107 are driven, so that the recording head is driven in accordance with the signal transmitted to the head driver 105.

Figure 4:
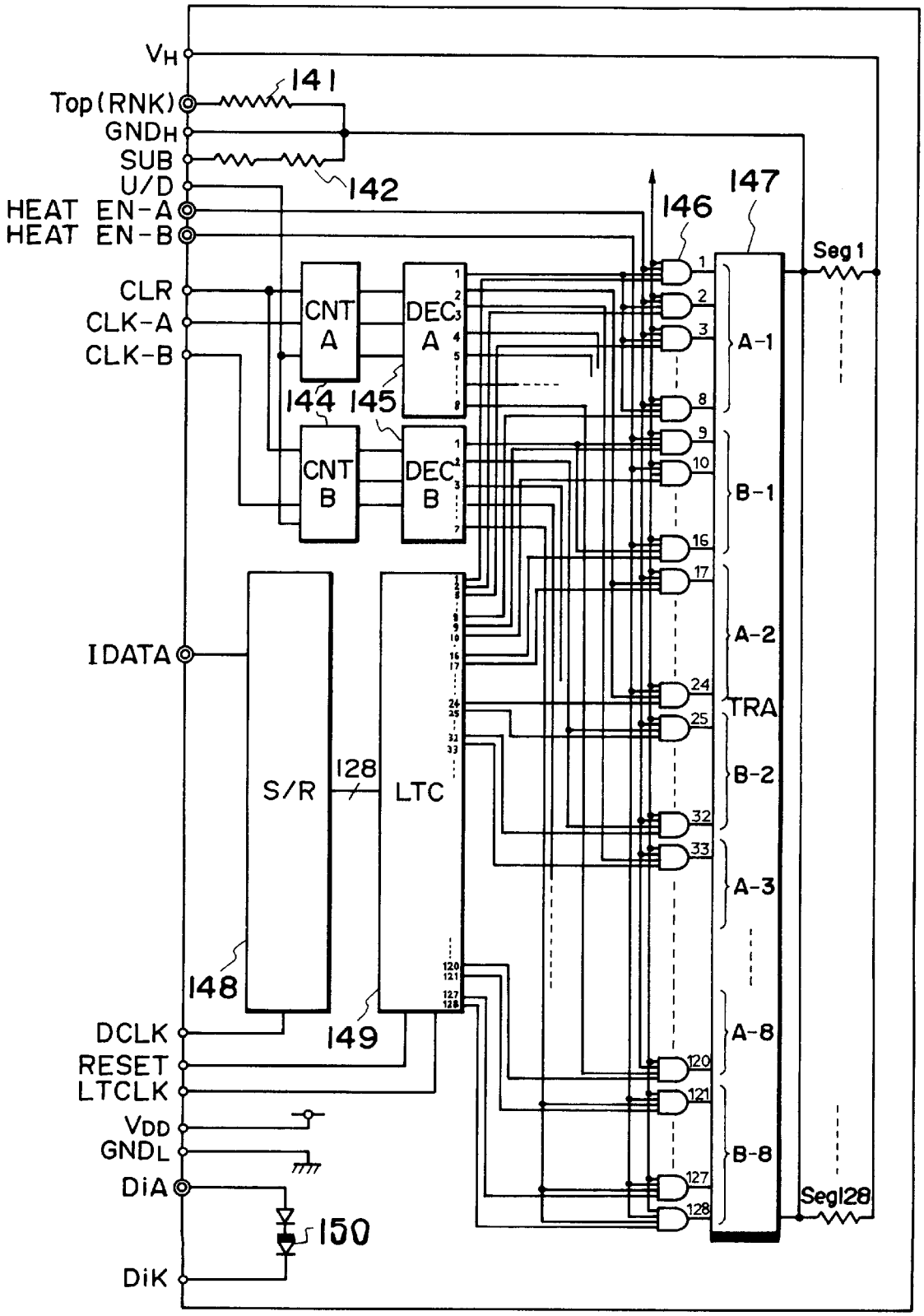
FIG. 4 is a block diagram of a driving circuit of Embodiment 1.

FIG. 4 is a block diagram of an example of a head driver in the gate array 104. One head has 128 nozzles and ejection heaters corresponding thereto. The ejection heaters are designated by seg 1–seg 128. A common electrode Vh is common to 128 ejection heaters. The common electrode Vh is supplied with a voltage of 20–35 V during recording operation. A terminal Top (Rnk) is used for discriminating a rank of the recording head. Depending on a resistance of a ranking resistance 141 therein, width, height or drive timing for the election heater drive pulse are corrected to provide uniform volumes of the ink droplet ejected from the recording head. A terminal GND is used to provide a reference voltage for a driving circuit for the 128 ejection heaters. A terminal SUB is used for the sub-heater 142. The sub-heater 142 is used to raise the recording head temperature. The sub-heater 142 is provided at each of left and right end of the recording head.

Designated by HeatEN-A, heatEN-B are enabling signal terminals for an ejection heater drive for blocks A and B, respectively. These terminals are independently controllable.

Designated by REST, CLK-A, CLK-B, U/D are terminals relating to a counter 144*a* and a counter 144B for selecting the nozzles for which data is set, for each block. There is provided a decoder 145 next to the counter 144, and further next thereto, a logic 146 for providing logic multiple with the recording signal, and is connected to the associated heater through a transistor array 147. The RESET is used to clear the counter 144. Clock terminals CLK-A and CLK-B are connected with counters 144A and 144B. A terminal U/D is used to select increment or decrement of the counter 144. During reciprocal recording operation, the counter is incremented in the forward stroke and is decremented in the backward stroke, thus alternating the counting up and down operations.

A terminal IDATA is a data input terminal, and the data is inputted in synchronism with the data clock signal from DCLK terminal, and the data are latched temporarily by 128 bit latching circuit through a 128 bit serial-parallel converter circuit 148. The RESET terminal functions also as a reset terminal for the latching circuit 149. A terminal LTCLK functions to supply a latch signal to the latching circuit 149.

A terminal VDD is an input terminal of the voltage from the voltage source for a logic system, it provides 5 V in this embodiment. A GNDL terminal functions to provide the logic system reference voltage. Between a terminal DiA and a terminal DiK, a series of two diodes is connected. The diodes 150 are disposed at the left and right of the recording head, respectively, to provide an average temperature of the recording head.

Figure 5:
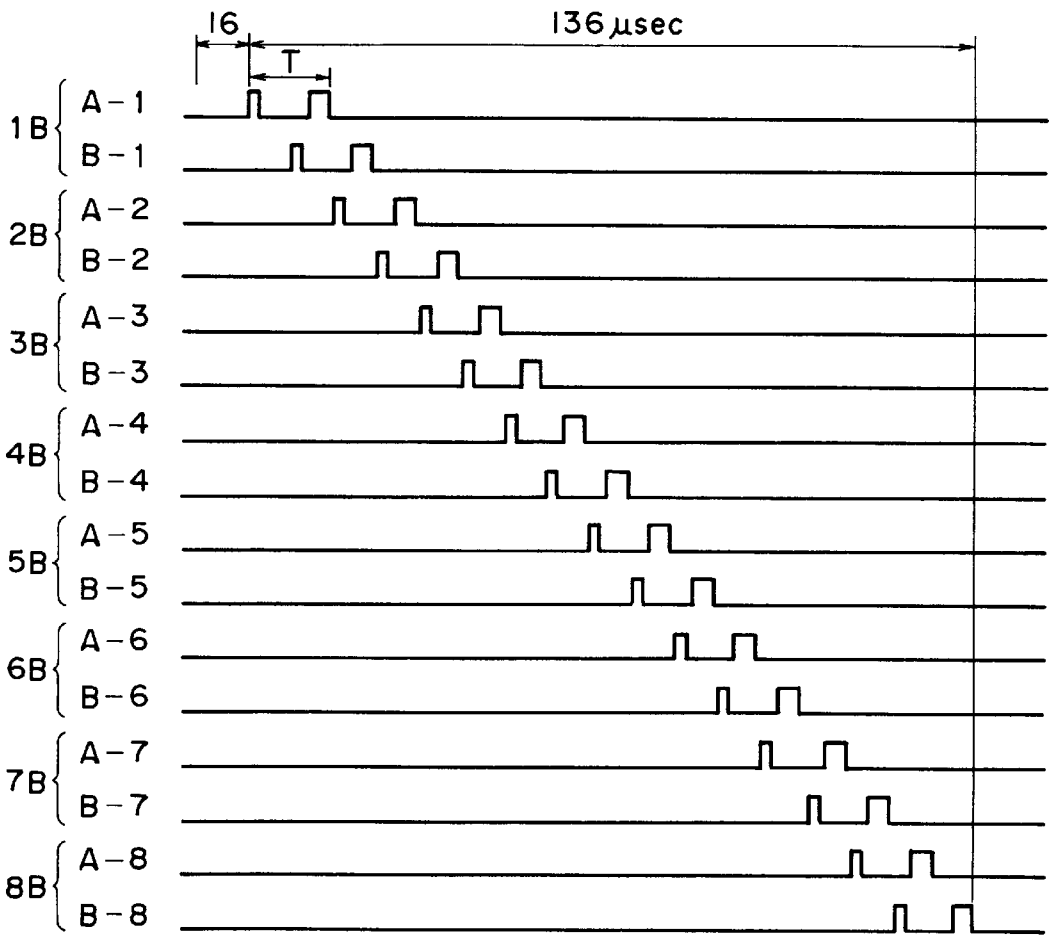
FIG. 5 is a timing chart 1 of a driving circuit used in Embodiment 1.
Figure 6:
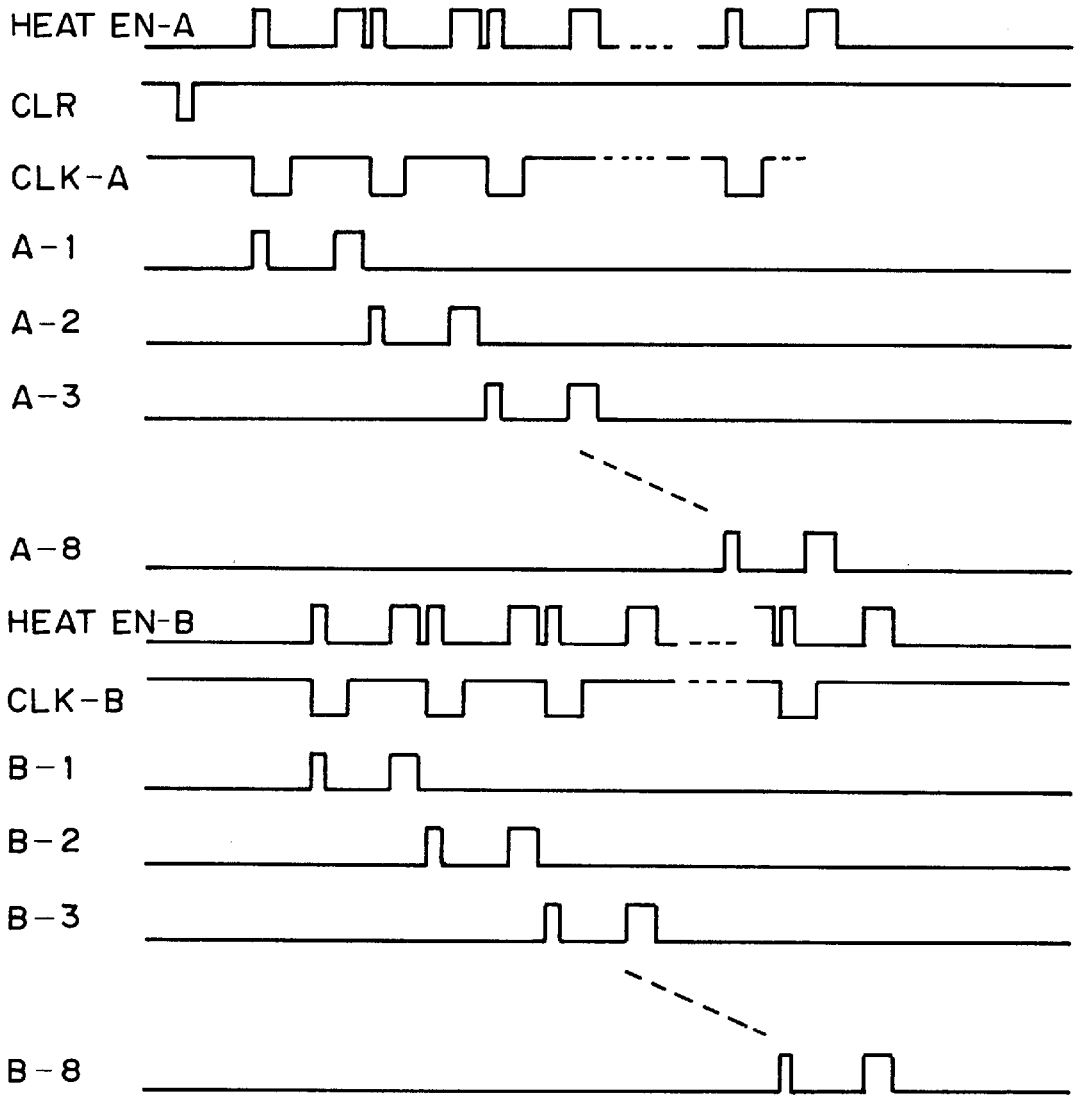
FIG. 6 is a timing chart 2 of a driving circuit in Embodiment 1.

FIG. 5 is a timing chart illustrating on-off timing of the ejection heaters of the driving block. FIG. 6 is a timing chart illustrating a timing of a counter.

Referring to FIG. 5, the present embodiment requires approximately 16 ($\mu$sec) to set and latch data. The total heating period is 136 ($\mu$sec). Therefore, 152 ($\mu$sec) is required in total. The drive frequency of the recording head is approximately 6.6 KHz.

In FIG. 6, HeatEN-A and HeatEN-B are signals which are independent from each other. The terminal RESET is common to the counter 144A and the counter 144B. First, RESET signal is supplied to clear the counter 144. At this time, U/D is set to increment, for example. When the clock pulses supplied from CLK-A in synchronism with HeatEN-A to CLK-A, one ejecting heating pulse is generated for block A-1. When data is in the nozzle corresponding to the block A-1, the ink is ejected by the pulse. Subsequently, the block A-2, block A-3, . . . , block A-8 are driven, similarly. When a clock signal is supplied to CLK-B in synchronism with HeatEN-B from CLK-B, one ejecting heating pulse is generated for the block B-1, the timing of the heat pulse is such that it is not overlapped with an on-period of the heat pulse for the block A. The timing will be described in detail hereinafter. Similarly, the operations continue to block B-8.

Between the pre-pulse and the main pulse for block A-1, there is a pre-pulse for block B-1. Between the pre-pulse and main pulse for block B-1, there is a pre-pulse for block A-2. The same applies up to block B-8. Thus, there is no time overlap of the heating period T between the pre-pulse and the main pulse, in the blocks A-1–A-8. The same applies to blocks B-1–B-8.

On the other hand, the block A and block B are sequentially overlapped, and between the pre-pulse and the main pulse of each of the blocks A and B, a pulse of different block is overlapped.

At this time, during the overlapped heating period T, the pre-pulse and the main pulse of each of blocks A and B, are not overlapped with each other. In this manner, the ejection heaters are driven for each of the blocks.

Figure 7:
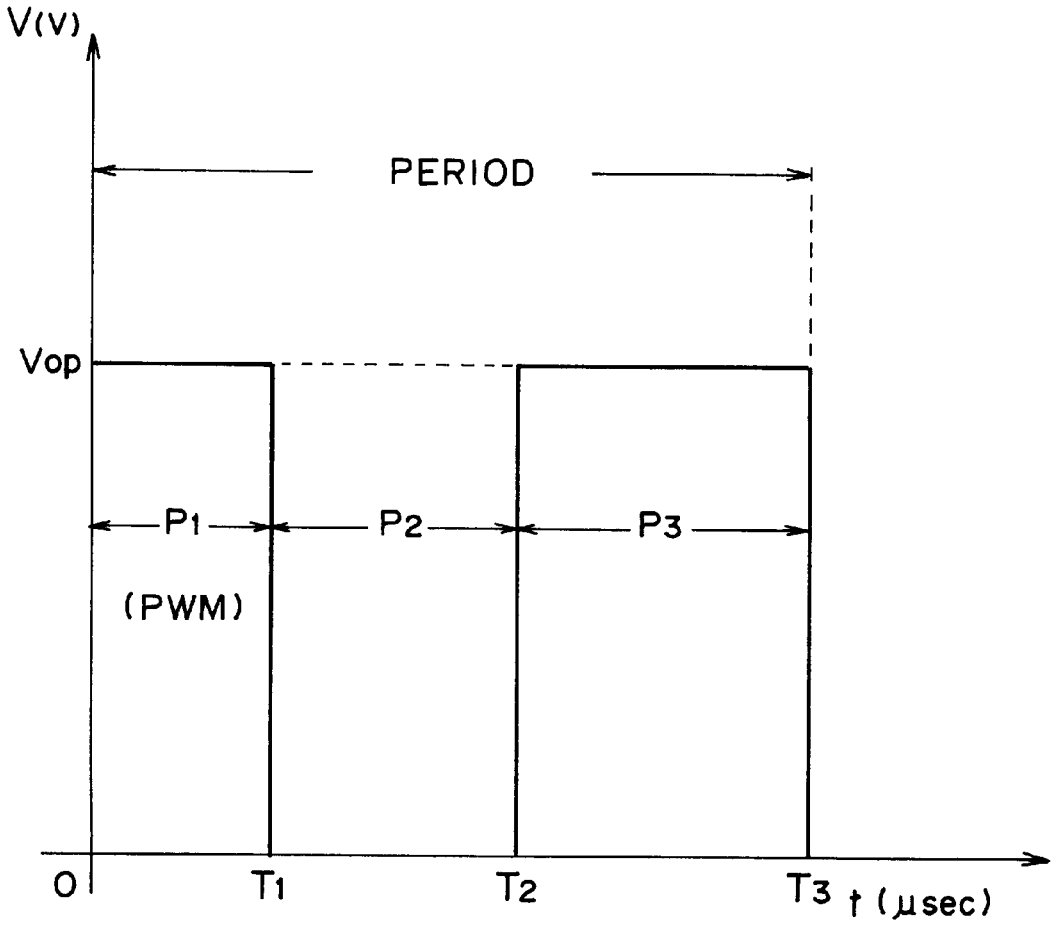
FIG. 7 shows a waveform of driving pulses for the recording head.

The description will be made as to ejection amount control method in this embodiment. Here, the method disclosed in U.S. Ser. No. 821,773 is used. For the ejection amount control, the head driving waveform is particularly controlled. The head drive uses divided pulses. As a typical pulse waveform, there is a double pulse waveform as shown in FIG. 7, wherein Vop is a drive voltage, P1 is a preheat pulse width, P2 is an interval timing (off-time), and P3 is a main heat pulse width. Designated by T1, T2 and T3 are time period for determining pulse widths P1, P2 and P3. Designated by Vop are electric energy required for generating thermal energy on the heater board HB, and is determined on the basis of an area, resistance, film structure of the heater board and/or the nozzle structure of the recording head.

In the divided pulse width modulation driving method used in this embodiment, the pulses are supplied in the order of P1, P2 and P3, wherein the pulse width P1 determines the pulse width before and during printing by head base temperature T1 (K, C, M, Y) which is represented by an output from a diode temperature sensor 150, so as to effect a PWM (pulse width modulation) control. The pulse width mainly controls the ink temperature distribution in the nozzle by the pre-heat pulse and is used for directly changing an ejection amount, so that the pulse width P1 is controlled in accordance with the head temperature. The control is such that pre-bubble-formation does not occur by too much heat applied to the heater board. Pulse width P2 corresponds to an interval time period and functions to provide a predetermined interval so as to prevent interference between the pre-heat pulse P1 and the main heat pulse P2 and also functions to control temperature distribution of the ink in the nozzle. The ejection amount can be controlled by the heat interval. The pulse width P3 of the main heat pulse is effective to create a bubble on the heater board to eject the ink droplet through an orifice. The pulse widths are determined on the basis of the area, the resistance, the film structure of the heater board and/or the nozzle structure or ink nature of the recording head.

Thus, if the head structure and the ink are determined, and the desired ejection amount Vd (p1/dot) is determined, the pulse widths P1, P2 and P3 may be determined by one skilled in the art. The number of combinations of the pulse widths P1, P2 and P3 for providing the same ejection amount is not limited to one. However, in consideration of the temperature dependency of the ejection amount which will be described hereinafter, the interval time P2 is as long as possible from the standpoint of expanding the controllable range of the ejection volume or quantity or amount, relative to the temperature change.

The description will be made as to the ejection amount control using the pre-heat pulse P1 (P2 is similarly usable).

Figure 8:
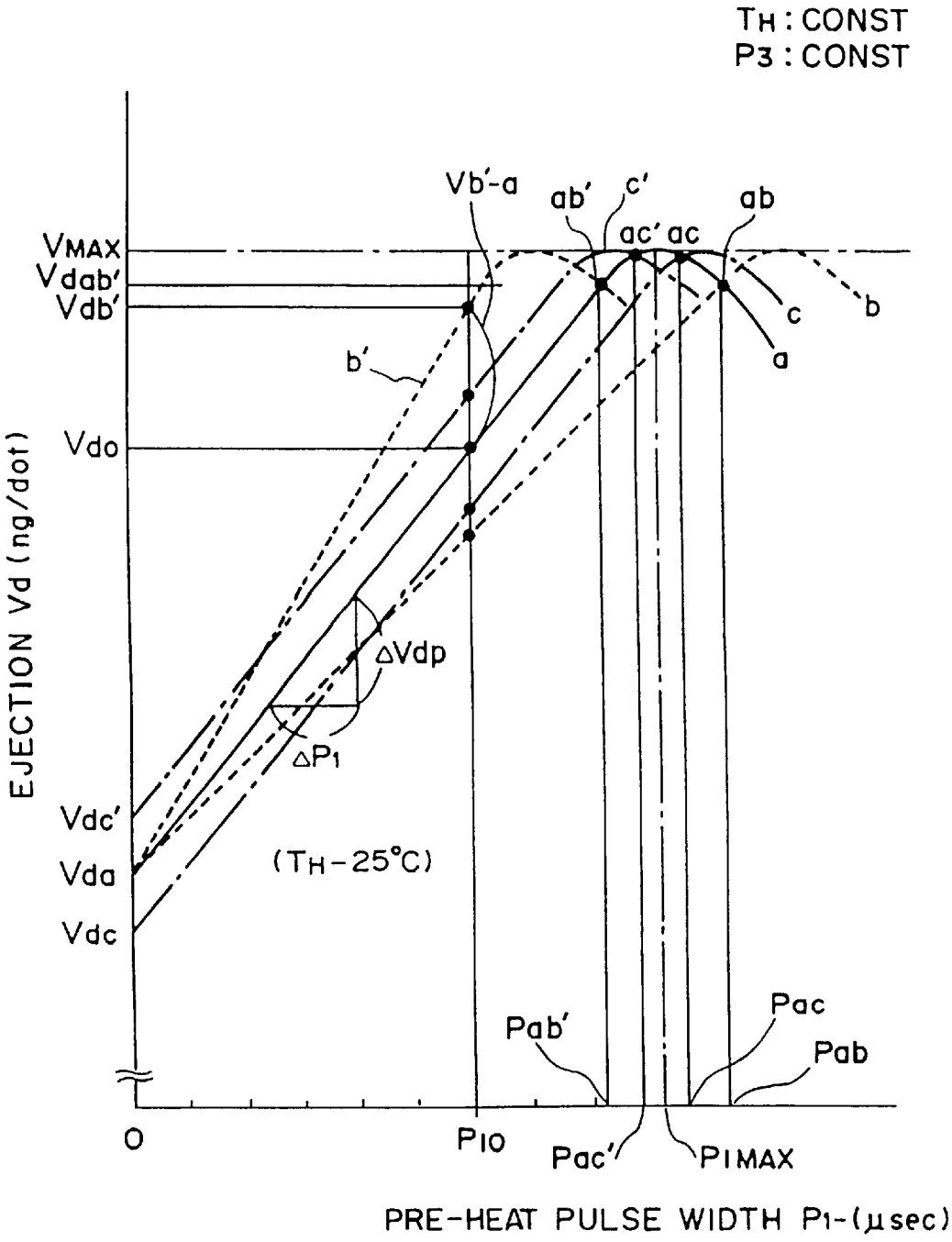
FIG. 8 shows a relationship between a prepulse P1 and an ejection amount Vd.
Figure 9:
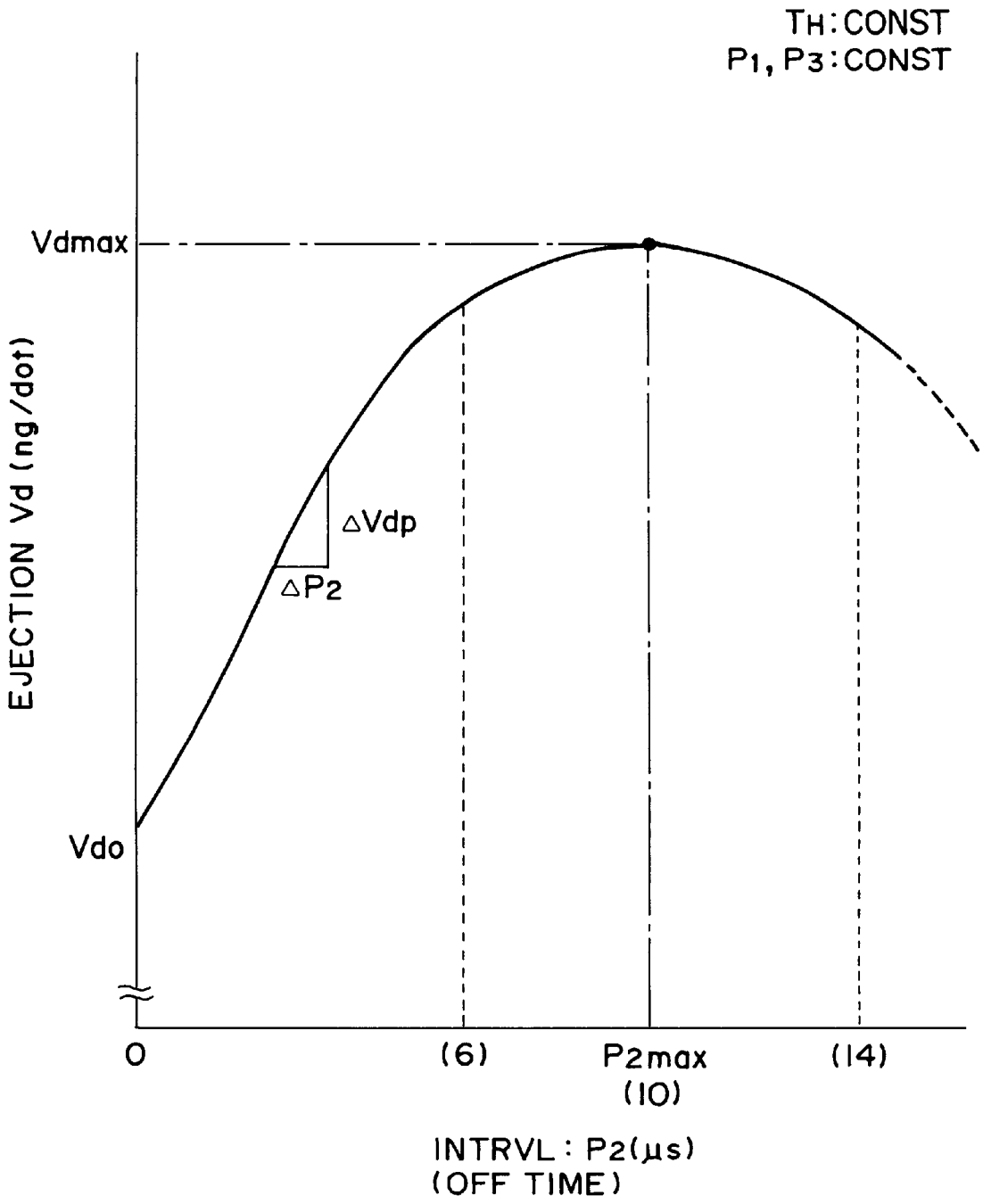
FIG. 9 shows a relationship between an interval P2 and an ejection amount Vd.

Under the condition of the constant head temperature (TH), the relationship between the preheat pulse P1 and the ejection amount VD is such that it linearly (or non-linearly) increases with an increase of the pulse width P1 up to P1LMT, and thereafter, the bubble formation by the main heat pulse P3 is disturbed by the pre-bubble-formation, and the ejection amount reduces beyond P1MAX, as shown in FIG. 8, under the conditions of a constant head temperature (TH) and constant P1/P3, the relationship between the pre-heat pulse P2 and the ejection amount VD is such that the ejection amount decreases with an increase of the pulse width P2 (main codes is decrease of the temperature) beyond P2MAX, as shown in FIG. 9. The investigations by the inventors, have revealed that P2MAX is ruled by thermal conductivity determined by head structure or the ink property or the like, and substantially a constant ejection amount can be provided in the range of approximately 10±4 (μsec).

Figure 10:
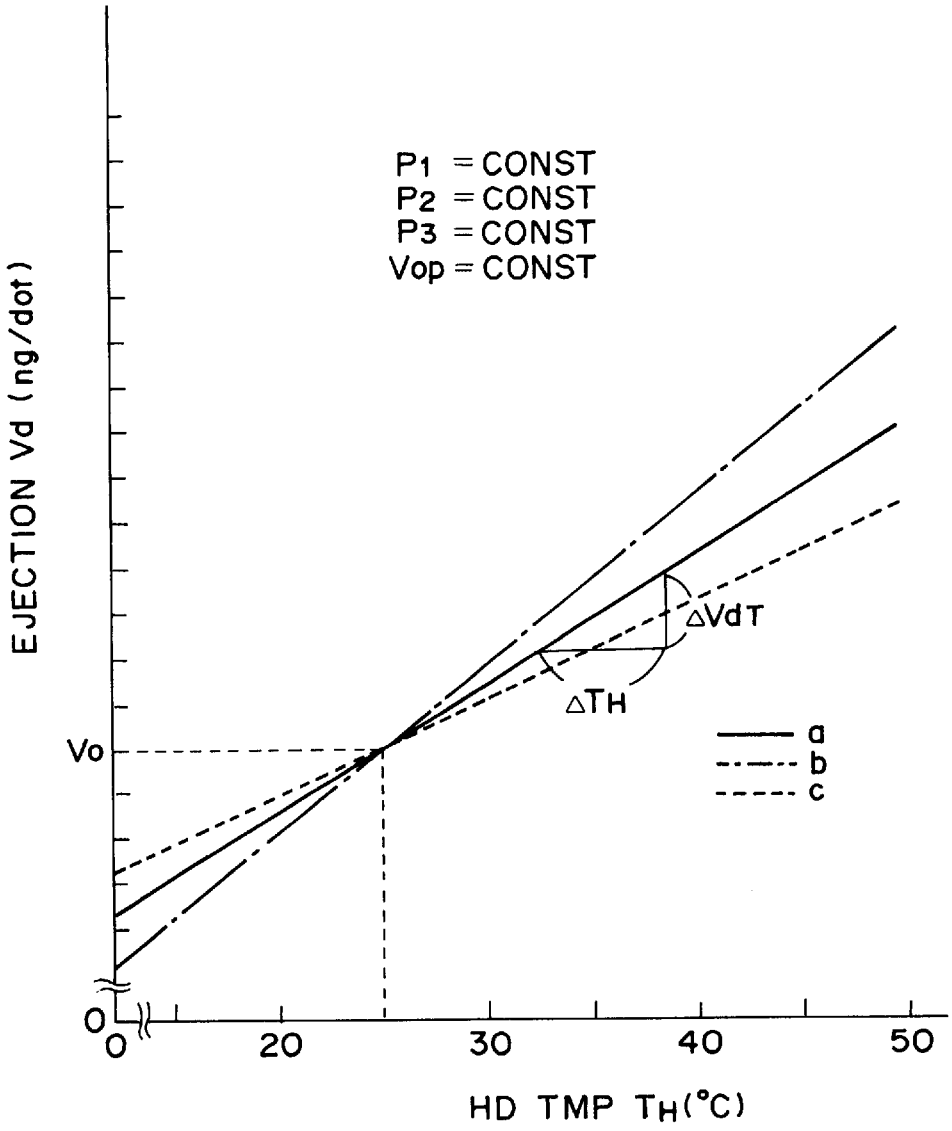
FIG. 10 shows a relationship between an ambient temperature and an ejection amount.
Figure 11:
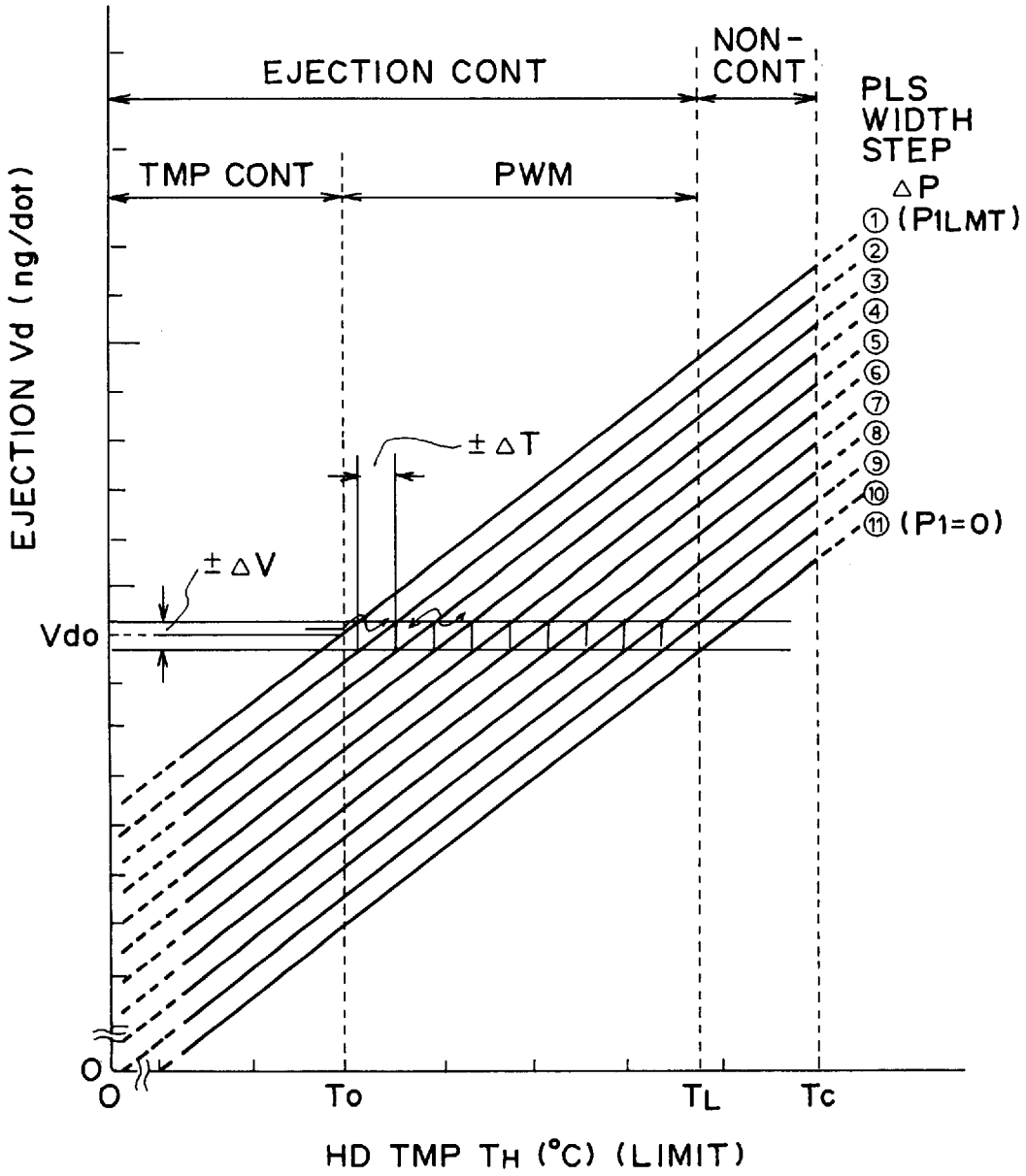
FIG. 11 shows an ejection amount control in this embodiment.

Under the constant pre-heat pulse P1, the relationship between the head temperature TH (ambient temperature) and ejection amount VD is such that it linearly increases with increase of the head temperature TH, as shown in FIG. 10. The coefficient in the linearity regions are the coefficient of pre-heating pulse dependency of the ejection amount:

$$KP1=\Delta VDP/\Delta P1(ng/\mu s\cdot dot)$$

Coefficient of interval time dependency of the ejection amount:

$$KP2=\Delta VDP/\Delta P2(ng/\mu s\cdot dot)$$

Coefficient of the temperature dependency of the ejection amount:

$$KTH=\Delta VDP/\Delta TH\ (ng/^{\circ}C.\cdot dot)$$

With the head structure used in this embodiment, the above coefficients are:

$$KPBk=8.25(ng/\mu sec\cdot dot)$$

$$KTHBk=0.7(ng/\mu sec\cdot dot)$$

By properly utilizing the relationship of the above two, more particularly, by effecting pulse width modulation control of the pulses P1 and P2 in accordance with the head temperature, the ejection amount can be maintained constant even if the head temperature changes due to ambient temperature and due to the self-temperature-rise by the printing action. In this manner, an ejection property control method (ejection amount and ejection speed) for maintaining the ink ejection amount for each color at a constant level is achieved.

As for the ejection property of the recording head using the above described method in which the respective colors are independently controlled, the optimum driving conditions are accomplished to stabilize the ink ejection under the conditions of the head temperature TH=25° C. and VOP−28 V, if P1=2.00 μsec, P2=9.0±3 μsec and P3=4.00 μsec. The ink ejection amount VD was 80.0 ng/dot, and the ejection speed was 14.0 m/sec.

In this embodiment, the offset drive is carried out for the purpose of high speed drive of the recording head. The method and means will be described in detail as to the offset drive in this embodiment. For the purpose of simplicity of the explanation, 64 nozzles are divided into 8×8 groups.

Figure 12A:
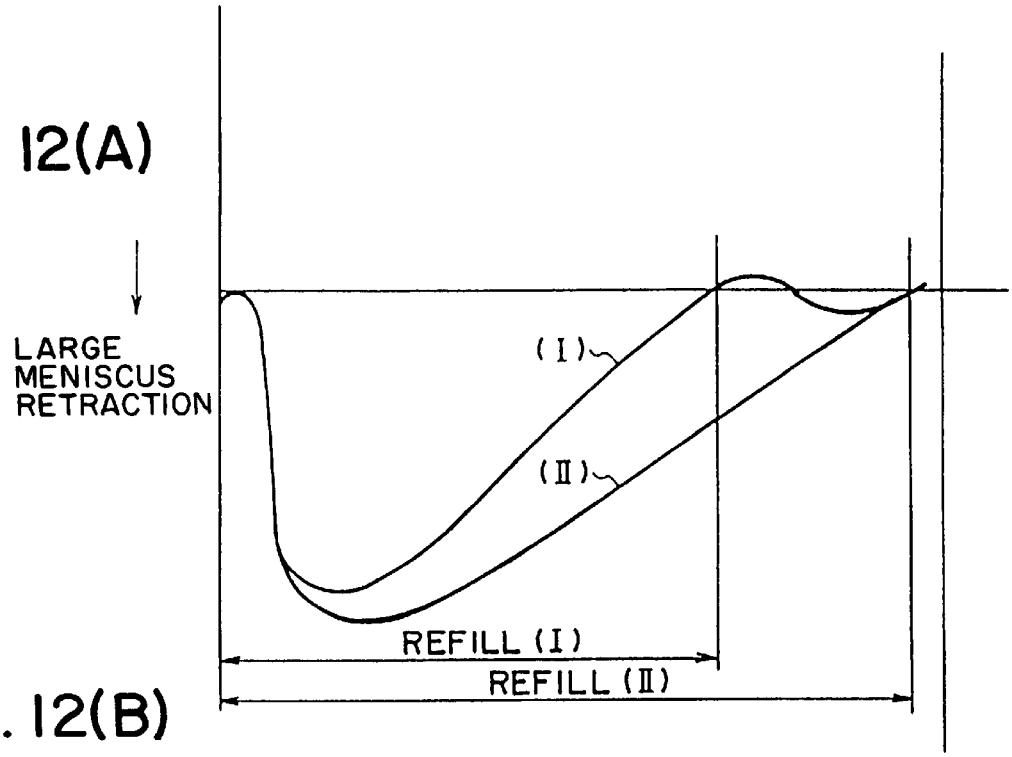
FIGS. 12(A)–(C) illustrate meniscus retraction according to this invention.
Figure 12B:
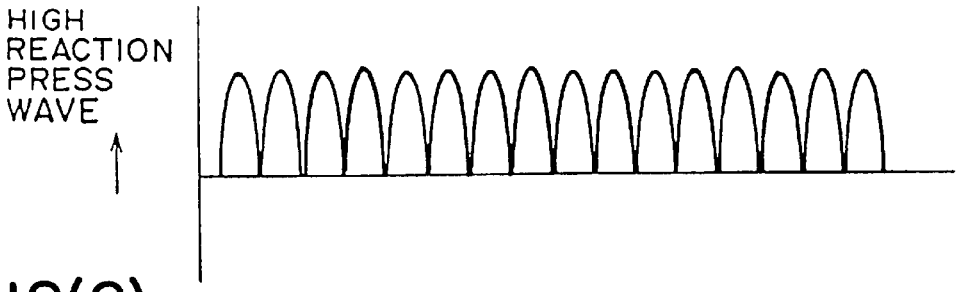
Figure 12C:
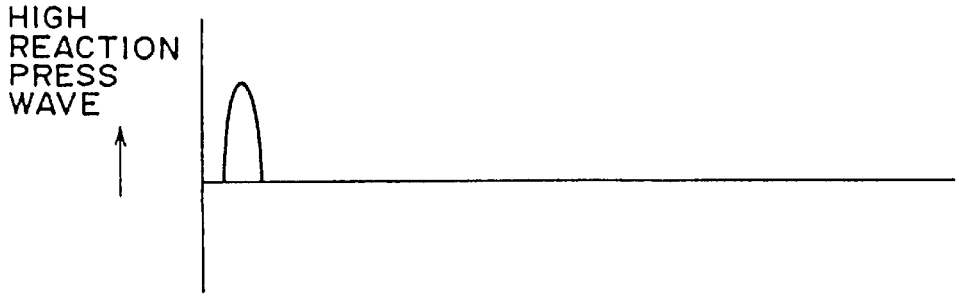

FIG. 12A illustrates meniscus retraction when the ink is subjected to a great number of ejection reaction pressure waves shown in FIG. 12, and when it is not subjected to the reaction pressure wave, as shown in FIG. 12C. As will be understood, the maximum meniscus retraction is small when it is subjected to the ejection reaction pressure wave. From the fact that the refilling curve is steep, it will be understood that the refilling speed is also high.

The maximum meniscus retraction is normally determined by the design value of the impedance of the nozzle and the vacuum level in the common liquid chamber. However, if an instantaneous positive pressure wave toward the common liquid chamber produced as a reaction to ejection of the next timing ejection is imparted before the maximum meniscus reaction is reached, the meniscus which is retracted at a high speed by the inertia after the ejection reaction, is impacted by the pressure wave so that the maximum retraction position is reduced.

The refilling speed is determined normally by the design value of the impedance of the nozzle and the negative pressure level in the common liquid chamber. However, by imparting the positive pressure described above multiple times during refilling, the refilling speed is increased.

Figure 13A:
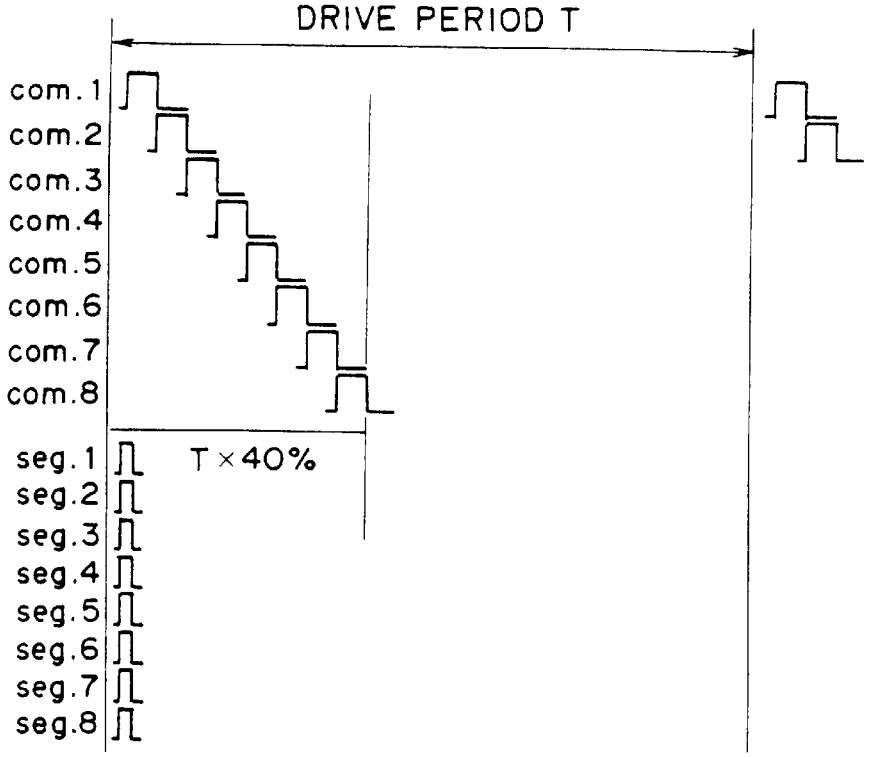
FIG. 13(A) illustrates drive periods according to the present invention.
Figure 13B:
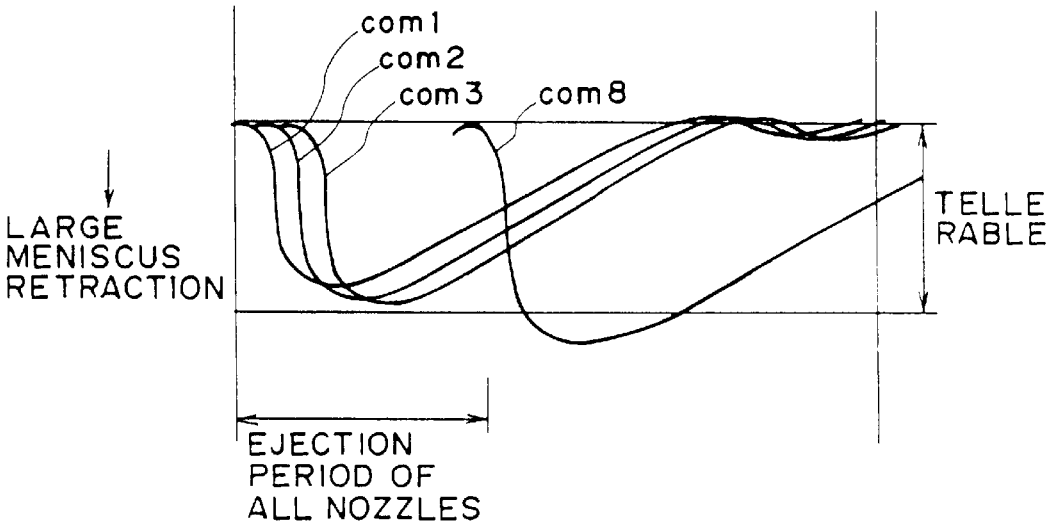
FIG. 13(B) illustrates meniscus retraction according to the present invention.
Figure 15:
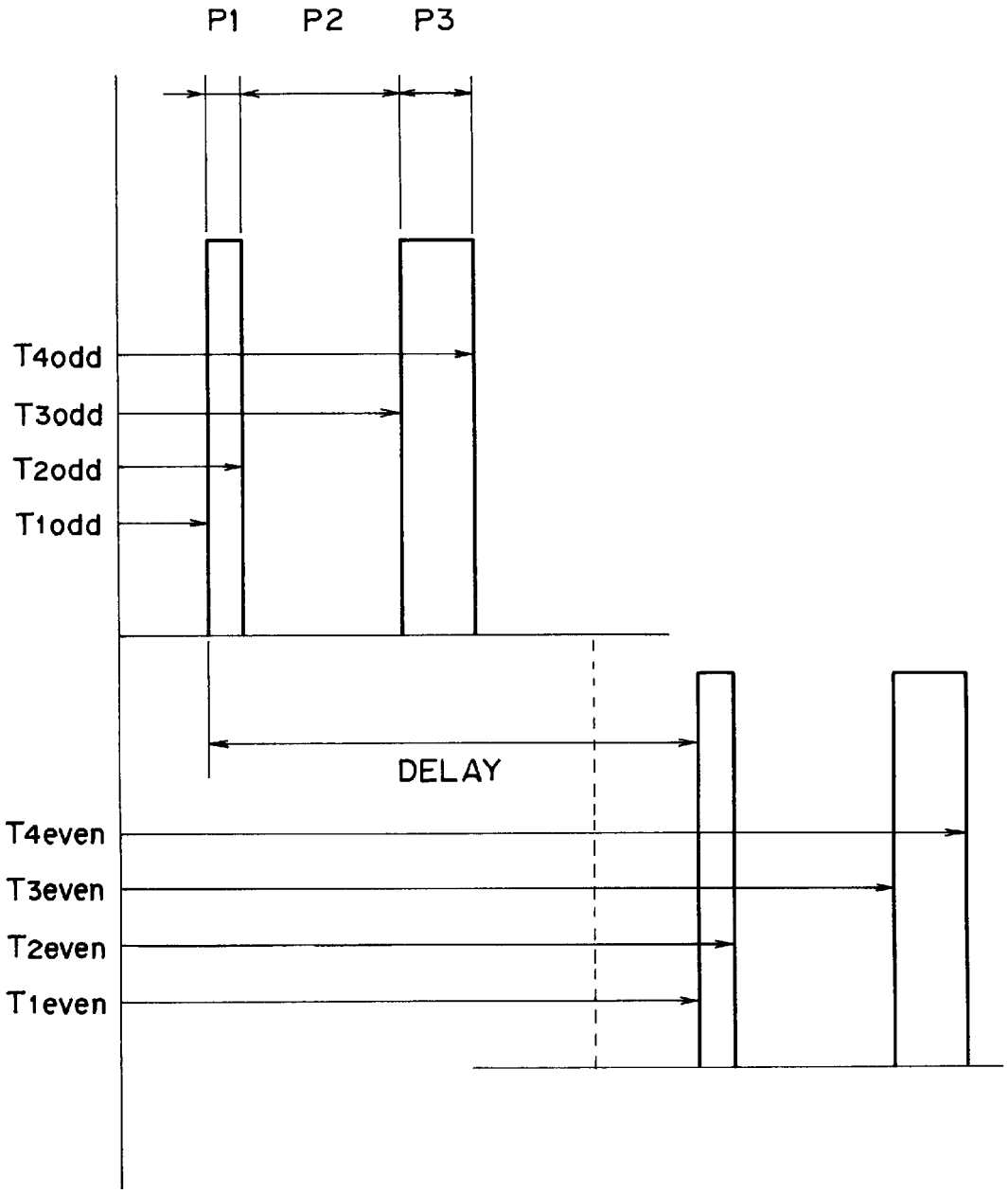
FIG. 15 shows a driving waveform used in a conventional offset driving.
Figures 16A, 16B, 16C:
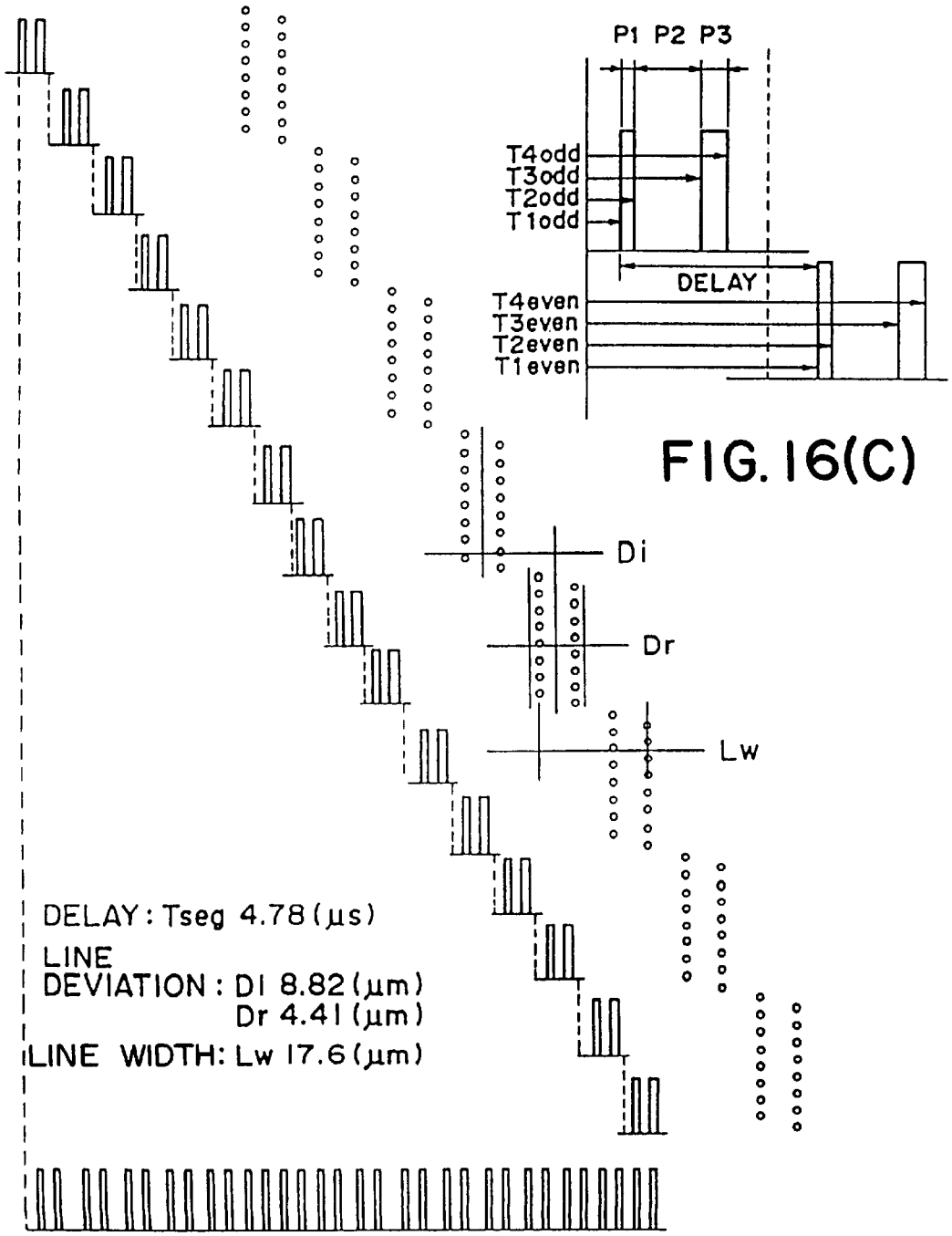
FIGS. 16(A), (C) illustrate waveforms of a conventional offset drive.
FIG. 16(B) illustrates an alternating nozzle arrangement.
Figure 17:
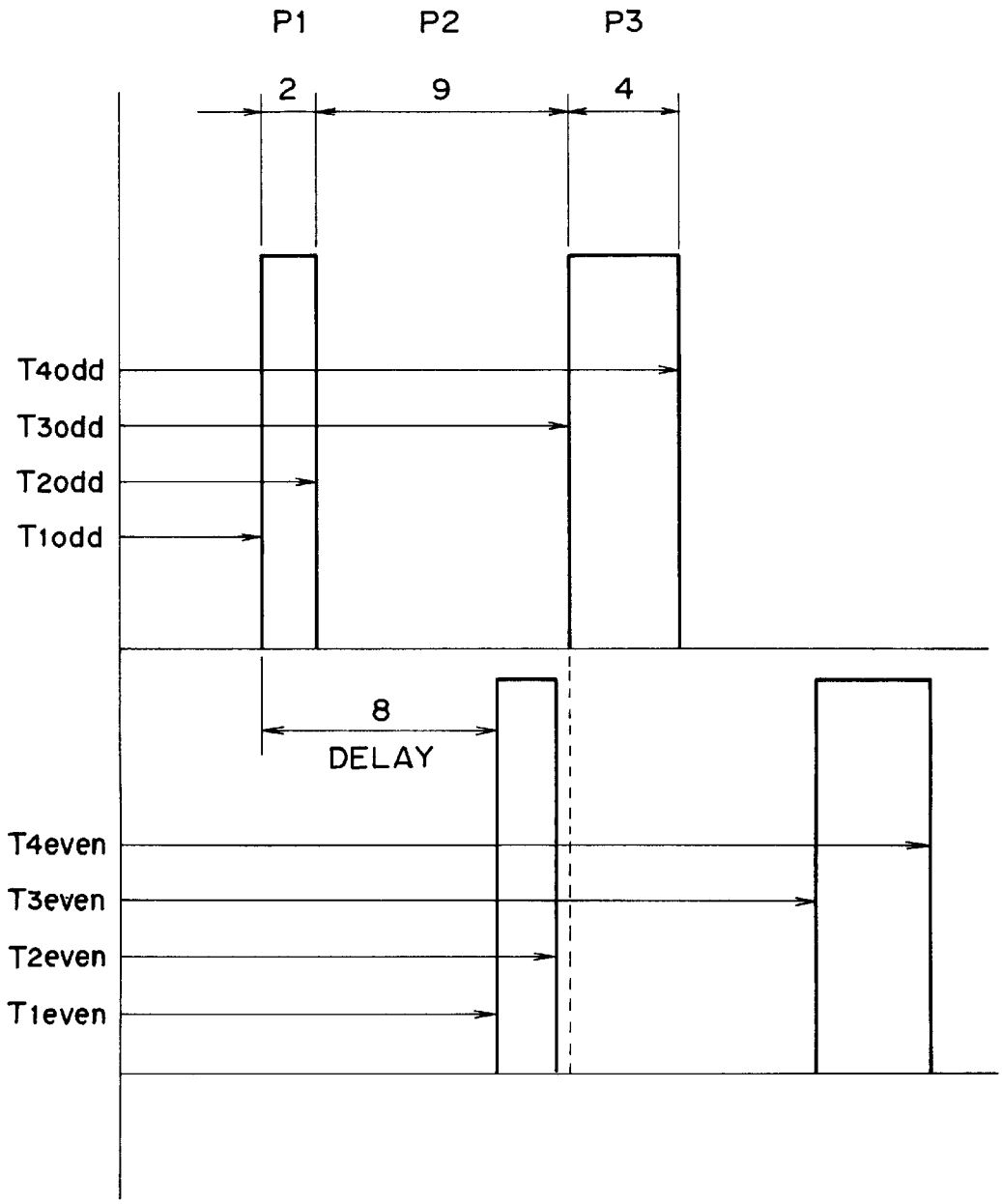
FIG. 17 shows a drive waveform in an interlace drive method according to this embodiment.
Figures 18A, 18B, 18C:
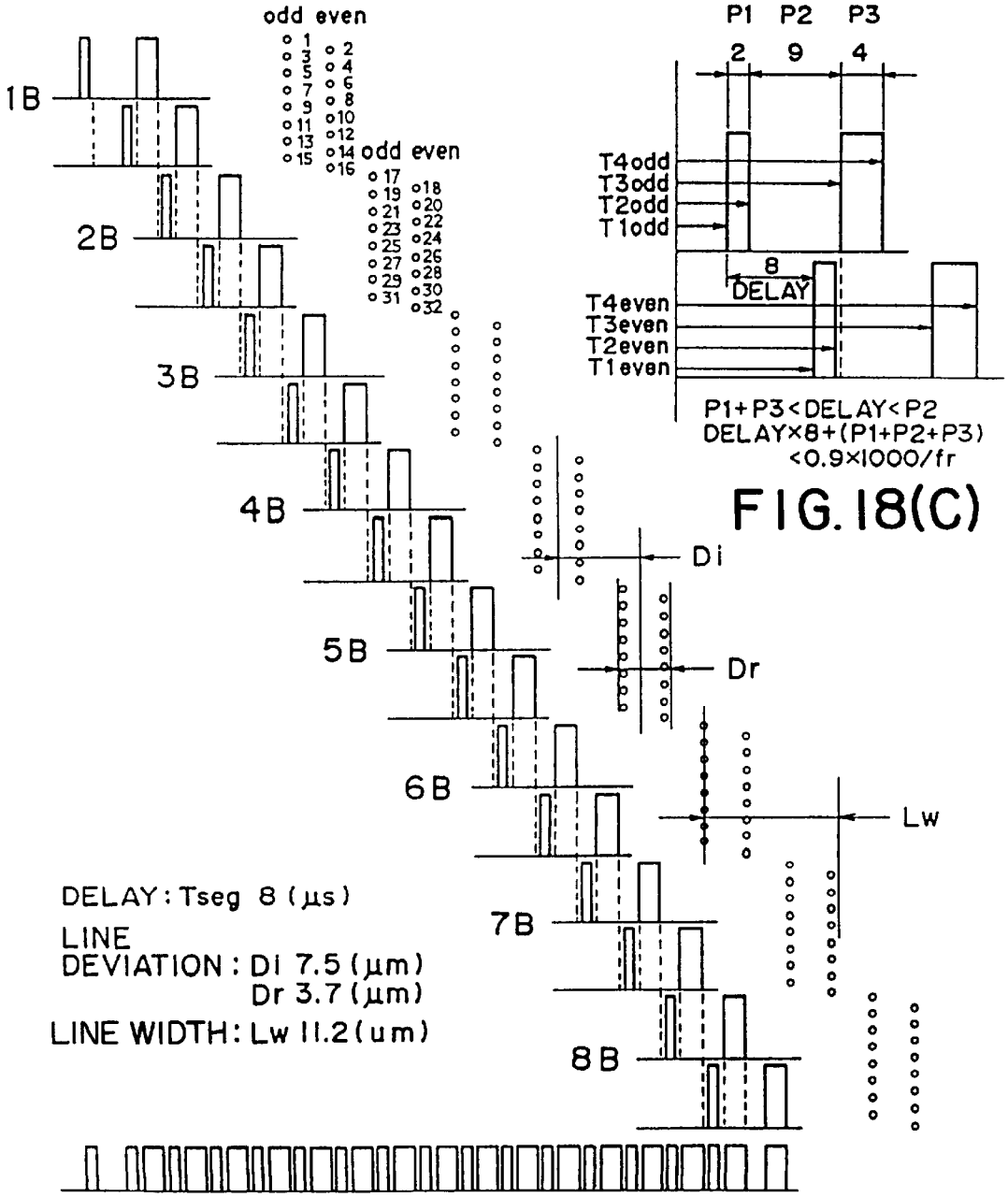
FIGS. 18(A), (C) illustrate drive waveforms of an interlace drive method used in Embodiment 1.
FIG. 18(B) illustrates an alternating nozzle arrangement.

In view of this, the meniscus retraction change with and without offset drive will be considered. FIGS. 13A and 13B show an example without the offset drive. In FIG. 13B, it will be understood that the maximum meniscus retraction and the refilling speed change gradually in the order of nozzle 1 of COM1, nozzle 9 of COM2, nozzle 17 of COM3 and nozzle 57 of COM8. The nozzle ejecting the ink at the timing COM1 receive the ejection reaction pressure waves of all of the subsequent ejections from the initial stage of the refilling action, and therefore, the refilling speed is highest. Toward the latter nozzles (COM2, COM3 and COM8), the number of ejection reaction pressure waves imparted to the initial stage of the refilling action decreases, and therefore, the refilling speed decreases. As regards COM8, the maximum meniscus reaction is maximum with the result that a longer refilling time is required. On the other hand, the offset drive of FIG. 14(A)–(B) is carried out in this embodiment. In this embodiment, the shifting is effected such that the timings of the segment signal SEG are determined to prevent simultaneous ejections of the adjacent nozzles. In addition, since the common signal COM is originally shifted, four nozzles are sequentially actuated from ejection heater Hi to the ejection heater H64 without actuating the adjacent nozzles. FIG. 14B shows the maximum meniscus retraction for the nozzles associated with each of the common signals. As will be understood from the Figure, the meniscus retraction distances for the nozzles driven by each of the common signals are uniform, as contrasted to the case without the offset drive. Particularly in the nozzles driven by the common signal COM8 (last drive), the meniscus retraction is within the tolerable range.

As described in the foregoing, the ink refilling into the nozzle is positively assisted by the offset drive in this embodiment, and therefore, the high speed recording is accomplished.

The description will be made as to an interlace drive.

The following is combined:

1. multiple pulse application means for controlling ejection quantity (PWM control),
2. offset drive to reduce the fluid cross-talk,
3. effective use of the power source.

By the combination, high speed and high frequency multi-nozzle drive (interlace drive) is accomplished.

When the above-named offset control (2) operates in a usual manner, as shown in FIGS. 15 and 16(A)–(C), only after the ejection pulses (all of the plural pulses) for the nozzles in a certain block are completely finished, the ejection pulse waveform for the next block is outputted.

In this embodiment, as shown in FIGS. 17 and 18(A)–(C), after the first pulse waveform of plural pulses for the first block is completed, there is an interval time period prior to the second pulse waveform being supplied. During the interval period, the first pulse waveform for the second block is applied, and then, the second pulse waveform for the first block is supplied, and at the last stage, the second pulse waveform is supplied for the second block. Thus, the interlacing is effected so that the plural pulses are not overlapped, and the total pulse width Pop=P1+P2+P3 is assured, and the offset time (Tdelay) is assured.

In the following, the interlacing drive method for 128 nozzles with drive frequency f=6.6 (KHz), will be described.

The drive pulse waveform for even number and odd number nozzles, has Vop=28 V, P1=2 μsec, P2=9 μsec and P3=4 μsec. Here, P2 is close to 10 μsec corresponding to the maximum ejection described above.

First, 8 odd number segments 1, 3, 5, 7, 9, 11, 13 and 15 of the first block are simultaneously driven by double pulses.

Subsequently, 8 even number segments 2, 4, 6, 8, 10, 12, 14 and 16 of the first block are simultaneously driven in the manner that the pulse P11Beven of the double pulse drive of the even number nozzles of the first block is interposed between the pulse P11Bodd of the double pulse drive for the odd number nozzles in the first block and P31Bodd. At this time, the pulse P11Beven is delayed by approximately 8 μsec from P11Bodd.

Subsequently, 8 odd number segments of the second block are simultaneously driven in the manner that the pulse P12Bodd of the double pulse drive for the odd number nozzles in the second block is interposed between the pulse P11Beven and the pulse P31Beven. At this time, there exists a delay of approximately 8 μsec between the pulse P11Beven and P12Bodd.

Subsequently, similarly, 8 even number segments 18, 20, 22, 24, 26, 28, 30 and 32 of the second block are simultaneously driven.

In the similar manner, the even number nozzles to 8 block are subject to the interlace drive, by which approximately 15 μsec of the pulse open period (Tblock=P1+P2+P3) for each column is assured, and in addition, approximately 6.6 KHz drive is possible even if 128 nozzles are divided into 8 blocks, and they are subjected to the even-odd offset drive with offset time of approximately 8 μsec.

In order to avoid the overlapping between pulses to assure the interlace, the control parameters satisfy the following:

$$P1+P3<Tdelay\ (\text{offset time})<P2$$

$$Tdelay\times 15+(P1+P2+P3)<0.9\times 1000/fop$$

P1: pre-heat pulse width

P2: interval time (off time)

P3: main heat pulse width

Tdelay: offset time fop: drive frequency.

In order to provide the pulses P1 and P3 during the off time P2, P1–P3<P2 is satisfied. In order to avoid the overlapping between pulses P1 and P3, P1+P3<Tdelay, and Tdelay<P2 are satisfied. The second equation is satisfied by which the length of the pulse train is shorter than the drive period. In the second equation, the coefficient 0.8 is used in consideration of the margin for the delay or the like of the pulse (approximately 1 μsec in FIG. 14). Generally, the coefficient is 0.9–0.95. The pre-heat pulse width is changed in the range of 0–P1.

Figures 19A, 19B, 19C:
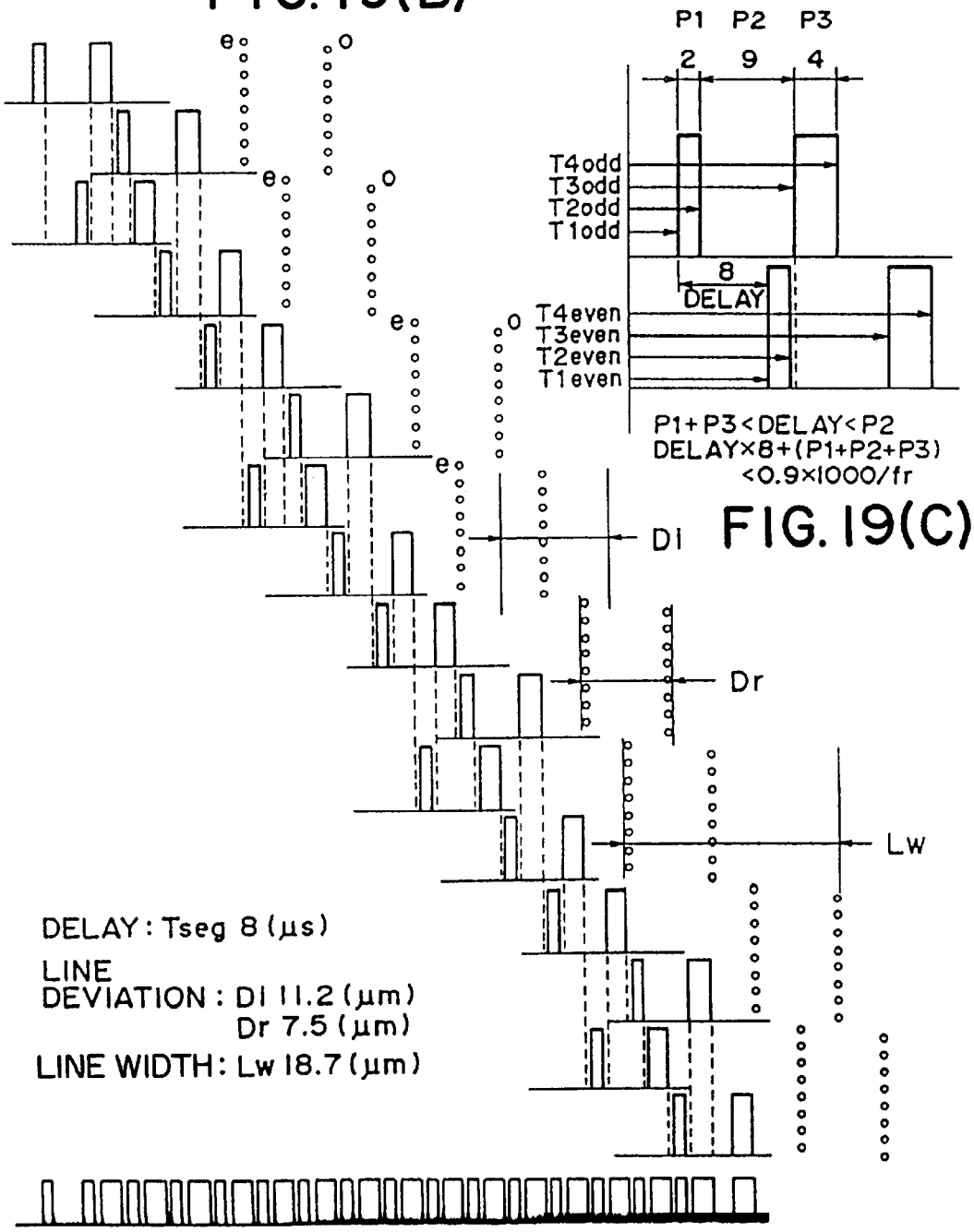
FIGS. 19(A), (C) illustrate drive waveforms of another interlace driving method used in Embodiment 1.
FIG. 19(B) illustrates an alternating nozzle arrangement.

In this embodiment, the even number and the odd number are alternate in the same block, but as shown in FIG. 19(A)–(C), the alternating drive of even number, even number, odd number and odd number, for example, is usable. With this method, the crosstalk can be further reduced.

As described in the foregoing, by the drive control means for alternating the advantageous effect and the disadvantageous effect of the driving means, the improper image recording resulting from the offset drive can be suppressed, thus accomplishing the high speed refilling action, and therefore, high speed and high quality image recording are possible.

Embodiment 2

Color printer (four colors) fine interlace

Figure 20:
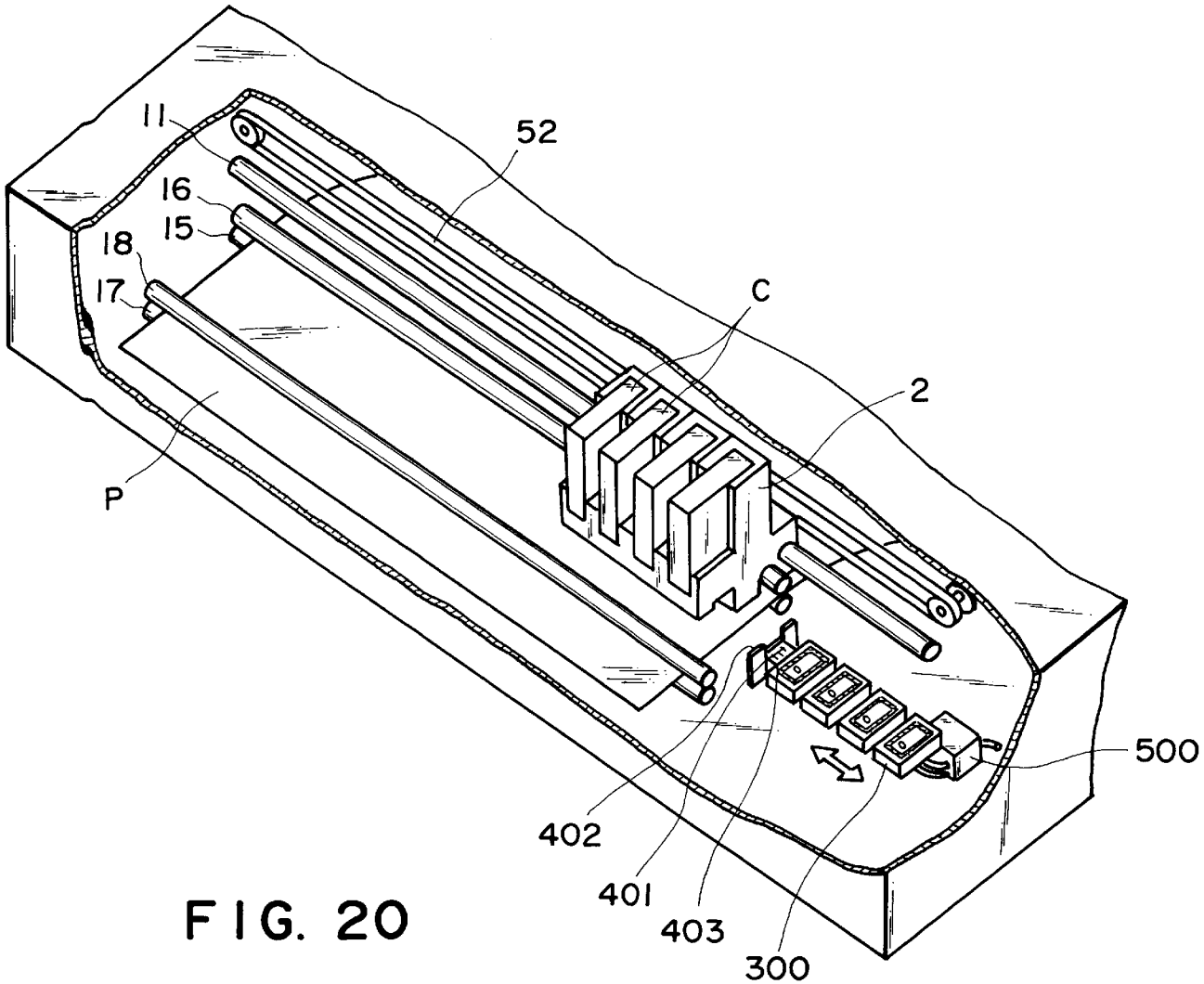
FIG. 20 is a perspective view of a color ink jet recording apparatus according to Embodiment 2.

FIG. 20 is a perspective view of a color ink jet recording apparatus employing the driving method of this invention. The apparatus is provided with exchangeable black (BK), cyan (C), magenta (M), yellow (Y) color recording heads. It is a full-color serial printer. The recording head has a resolution of 360 dpi, a drive frequency of 10.8 KHz, and is provided with 128 ejection outlets (nozzles).

In this embodiment, designated by C is a recording head cartridge having integral four recording heads for black, cyan, magenta and yellow colors. It comprises a recording head and an integral ink container for supplying the ink thereto. The recording head cartridge C is detachably mounted on a carriage by an unshown mounting structure. The carriage 2 is slidably engaged with the guiding shaft 11. It is also connected with a driving belt 52 driven by an unshown main scan motor. By this, the recording head cartridge C is movable for the scanning movement along the guiding shaft 11. Feeding rollers 15, 16 and 17, 18 are extended substantially parallel to the guiding shaft 11 at the front and rear portions of the recording region covered by the scanning of the recording head cartridge C. The feeding rollers 15, 16 and 17, 18 are driven by an unshown sub-scan motor to feed the recording material P. The recording material P constitutes a recording surface faced to the ejection side surface of the recording head cartridge C.

A recovery unit is provided faced to a movable range of the cartridge C, adjacent the recording region of the recording head cartridge C. The recovery unit is provided with a capping unit 30 provided corresponding to the plurality of recording heads of the cartridge C. With the movement of the carriage 2, it is slidable to the left and right, and is movable vertically. When the carriage 2 is at the home position, it is joined with the recording head to cap unit. In the recovery unit, designated by reference numerals 401 and 402 are first and second blade as wiping members; 403, a blade cleaner of a liquid absorbing material for example to clean the first blade 401.

A pump unit 500 is provided to suck the ink or the like from the ejection outlets and the neighborhood thereof of the recording heads through the cap unit 300.

Figure 21:
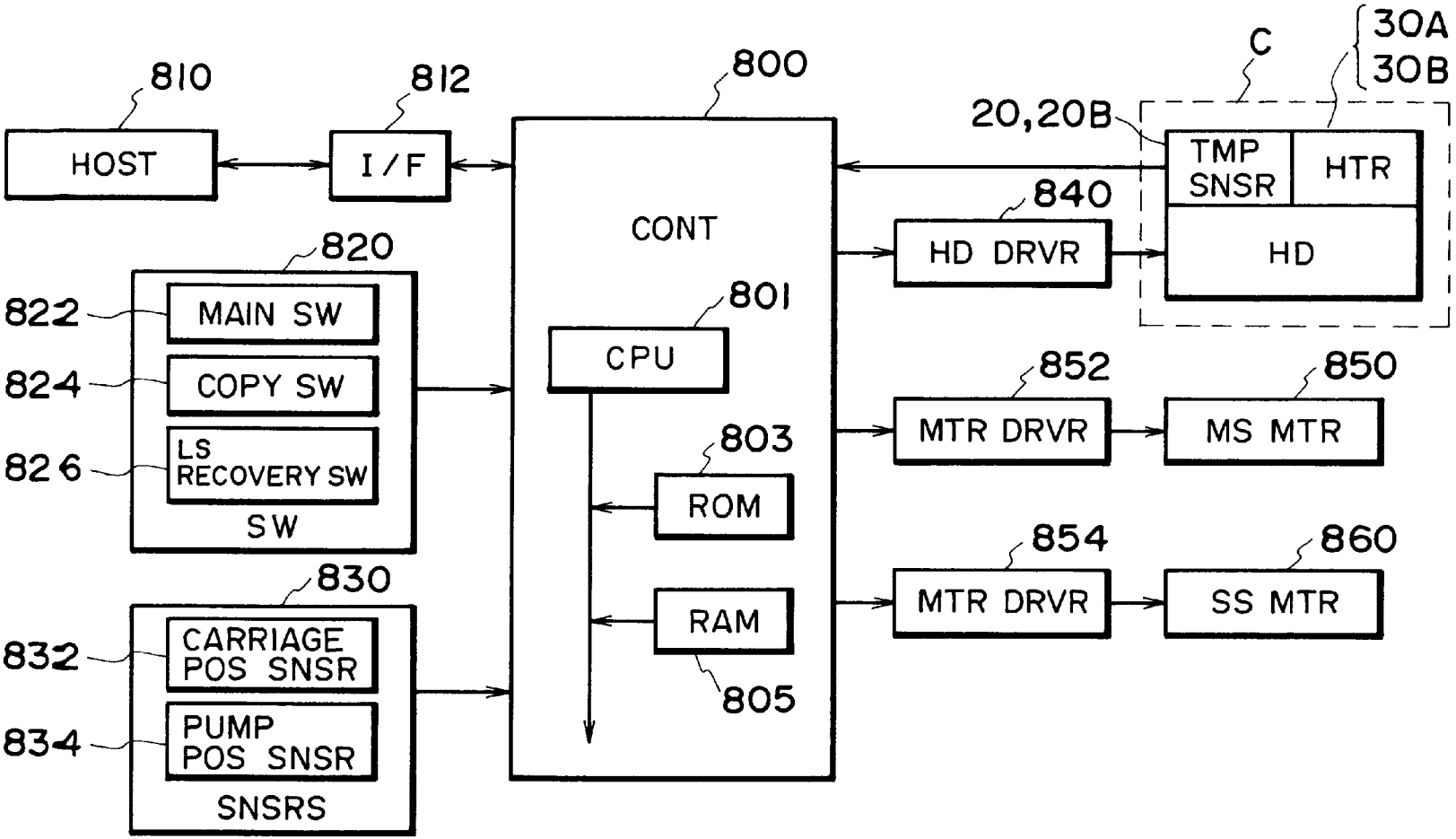
FIG. 21 is a block diagram of a control circuit used in Embodiment 2.

FIG. 21 is a block diagram of a control system for the color ink jet recording apparatus.

A main controller 800 comprises a CPU 801 in the form of a microcomputer for example, for executing various sequential control, ROM803 for storing program and table data corresponding to the sequential operations and other necessary values, a host apparatus for supplying image data (which may be an image reader). Image data, command signals, status signals or the like are transferred to the controller 800 through an interface (I/F) 812. Switches 820 includes a main switch 822, record start instruction switch 824 and recovery switch 826 for instructing start of recovery operation. They are operable by an operator. Sensors 830 include a sensor 832 for sensing the home position, start position or the like of the carriage 2, and sensors 834 including a leaf switch 530 for detecting pump position.

A head driver 840 functions to drive electrothermal transducers of the recording head in accordance with the image data. A part of the head drivers is used for driving heaters 30A and 30B. The outputs of the temperature sensors 20A and 20B are supplied to the controller 800. A main scan motor 850 is used for moving the carriage 2 in the main scan direction, and designated by 852 is a driver therefor. A sub-scan motor 860 functions to feed the recording material.

Figure 32:
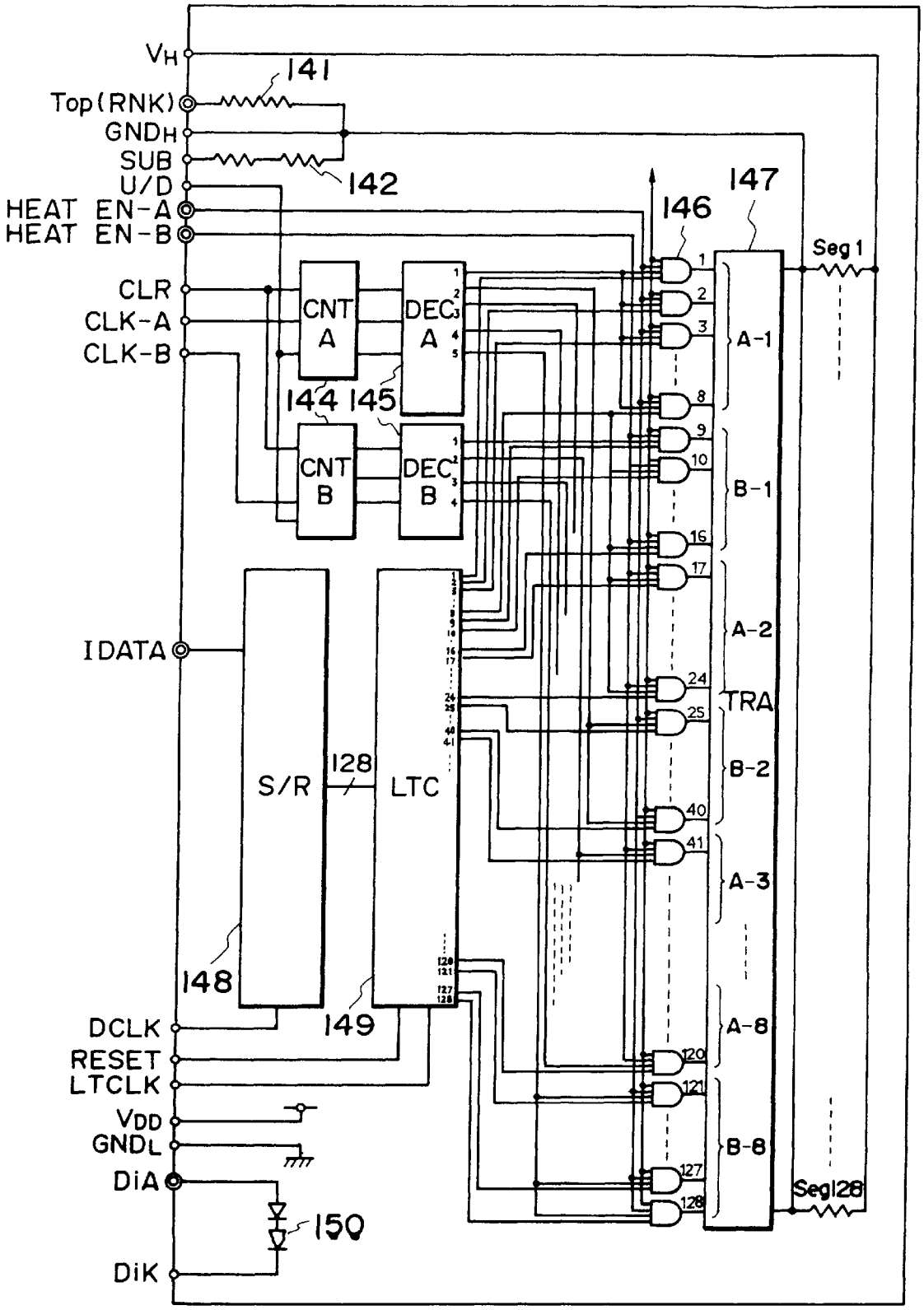
FIG. 32 is a block diagram of a driving circuit according to Embodiment 2.

FIG. 32 is a block diagram of an example of a head driver in the gate array 104. One head has 128 nozzles and ejection heaters corresponding thereto. The ejection heaters are designated by seg 1–seg 128. A common electrode vh is common to all 128 ejection heaters. The common electrode Vh is supplied with a voltage of 20–35 V during the recording operation. A terminal Top (Rnk) is used for discriminating a rank of the recording head. Depending on a resistance of a ranking resistance 141 therein, width, height or drive timing for the election heater drive pulse are corrected to provide uniform volumes of the ink droplet ejected from the recording head. A terminal GND is used to provide a reference voltage for a driving circuit for the 128 ejection heaters. A terminal SUB is used for the sub-heater 142. The sub-heater 142 is used to raise the recording head temperature. The sub-heater 142 is provided at each of left and right end of the recording head.

Designated by HeatEN-A, HeatEN-B are enabling signal terminals for ejection heater drive for blocks A and B, respectively. These terminals are independently controllable.

Designated by REST, CLK-A, CLK-B, U/D are terminals relating to a counter 144A and a counter 144B for selecting the nozzles for which data is set, for each block. There is provided a decoder 145 next to the counter 144, and further next thereto, a logic 146 for providing logic multiple with the recording signal, and is connected to the associated heater through a transistor array 147. The RESET is used to clear the counter 144. Clock terminals CLK-A and CLK-B are connected with counters 144A and 144B. A terminal U/D is used to select increment or decrement of the counter 144. During reciprocal recording operation, the counter is incremented in the forward stroke and is decremented in the backward stroke, thus alternating the counting up and down operations.

A terminal IDATA is a data input terminal, and the data is inputted in synchronism with the data clock signal from DCLK terminal, and the data are latched temporarily by a 128 bit latching circuit through a 128 bit serial-parallel converter circuit 148. The RESET terminal functions also as a reset terminal for the latching circuit 149. A terminal LTCLK functions to supply a latch signal to the latching circuit 149.

A terminal VDD is an input terminal of the voltage from the voltage source for a logic system, it provides 5 V in this embodiment. A GNDL terminal functions to provide the logic system reference voltage. Between a terminal DiA and a terminal DiK, a series of two diodes, is connected. The diodes 150 are disposed at the left and right of the recording head, respectively to provide an average temperature of the recording head.

Figure 33:
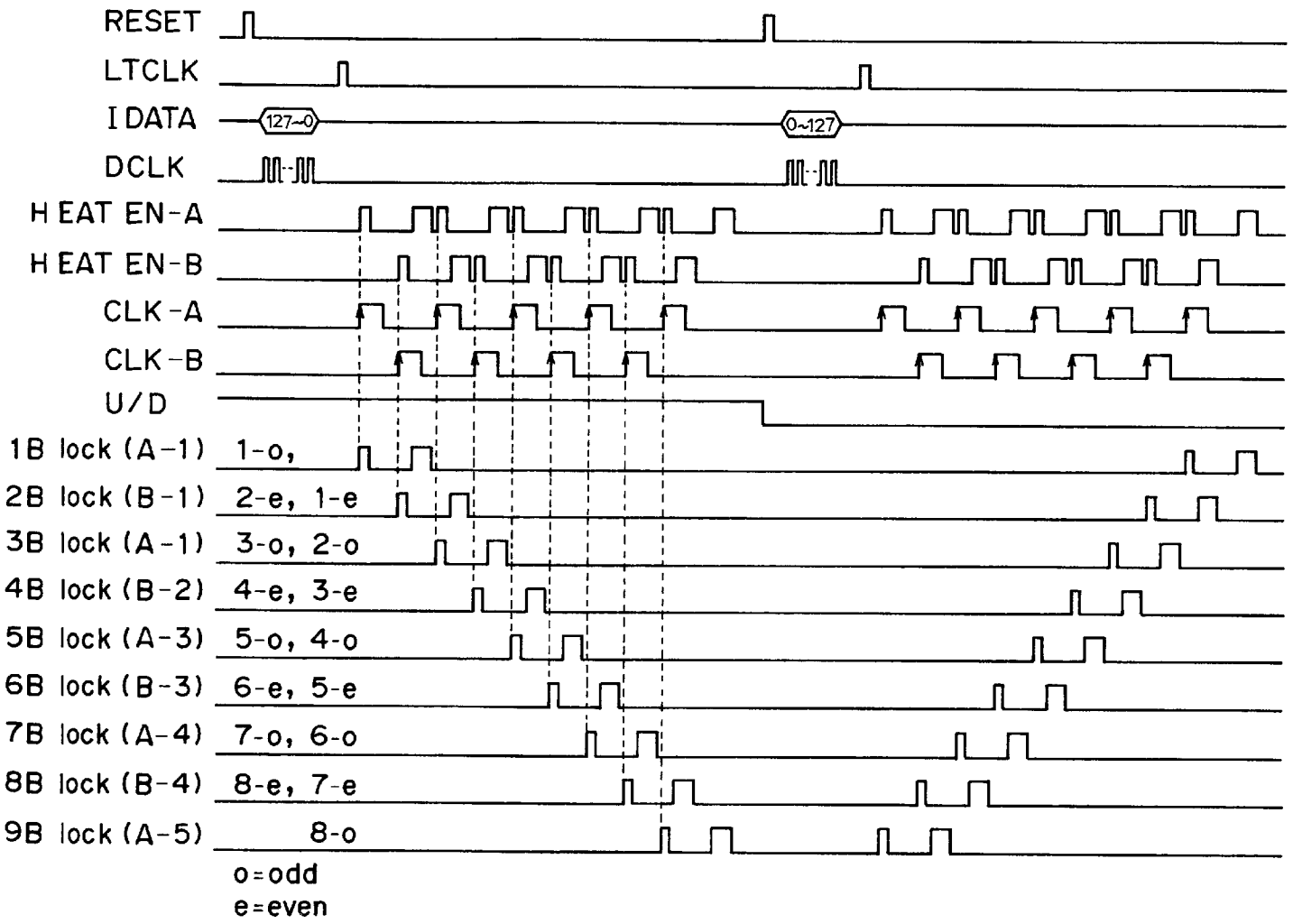
FIG. 33 is a timing chart of a driving circuit according to Embodiment 2.

FIG. 33 is a timing chart illustrating on-off timing of the ejection heaters of the driving block. FIG. 33 is a timing chart illustrating a timing of a counter.

Referring to FIG. 33, the present embodiment requires approximately 16 (μsec) to set and latch data. The total heating period is 76.6 (μsec). Therefore, 92.6 (μsec) is required in total. The drive frequency of the recording head is approximately 10.8 KHz.

In FIG. 33, HeatEN-A and HeatEN-B are signals which are independent from each other. The terminal RESET is common to the counter 144A and the counter 144B. First, RESET signal is supplied to clear the counter 144. At this time, U/D is set to increment, for example. When the clock pulses supplied from CLK-A in synchronism with HeatEN-A to CLK-A, one ejecting heating pulse is generated for block A-1. When data is in the nozzle corresponding to the block A-1, the ink is ejected by the pulse. Subsequently, the block A-2, block A-3, block A-4 and block A-5 are driven, similarly. When a clock signal is supplied to CLK-B in synchronism with HeatEN-B from CLK-G, one ejecting heating pulse is generated for the block B-1, the timing of the heat pulse is such that it is not overlapped with on-period of the heat pulse for the block A. The timing is as shown in FIG. 33. Similarly, the operations continue to block B-4.

In this manner, the ejection heaters are driven for the respective blocks.

In the following, the fine interlace drive method for 128 nozzles with drive frequency f=10.8 (KHz), will be described.

As shown in FIGS. 22(A)–(C) drive pulse waveform for even number and odd number nozzles, has Vop=28 V, P1=2 μsec, P2=9 μsec and P3=4 μsec. Nine blocks are driven (one is added).

First, 8 odd number segments 1, 3, 5, 7, 9, 11, 13 and 15 of the first block are simultaneously driven by double pulses.

Subsequently, 14 even number segments 2, 4, 6, 8, 10, 12, 14, 16, 18, 20, 22, 24, 26, 28, 30 and 32 of the second block are simultaneously driven in the manner that the pulse P12Beven of the double pulse drive of the even number nozzles of the second block is interposed between the pulse P11Bodd of the double pulse drive for the odd number nozzles in the first block and P31Bodd. At this time, the pulse P12Beven is delayed by approximately 8 gsec from P11Bodd.

Subsequently, 16 odd number segments 17, 19, 21, 23, 25, 27, 29, 31, 33, 35, 37, 39, 41, 43, 45 and 47 of the third block are simultaneously driven in the manner that the pulse P13Bodd of the double pulse drive for the odd number nozzles in the third block is interposed between the pulse P12Beven of the double pulse driven for the even number nozzles of the second block and the pulse P32Beven 34, 36, 38, 40, 42, 44, 46, 48, 50, 52, 54, 56, 58, 60, 62 and 64. At this time, there exists a delay of approximately 8 μsec between the pulse P13Bodd and P13Beven.

Subsequently similarly, 16 even number segments 34, 36, 38, 40, 42, 44, 46, 48, 50, 52, 54, 56, 58, 60, 52 and 64 of the fourth block are simultaneously driven. In the similar manner, the even number nozzles to 9 block are subjected to the interlace drive, by which approximately 15 μsec of the pulse open period (Tblock=P1+P2+P3) for each column is assured, and in addition, approximately 10.8 KHz drive is possible even if 128 nozzles are divided into 8 blocks, and they are subjected to the even-odd offset drive with offset time of approximately 8 μsec.

In order to avoid the overlapping between pulses to assure the interlace, the control parameters satisfy the following:

$$P1+P32<Tdelay\ (offset\ time)<P2$$

$$Tdelay\times 8+(P1+P2+P3)<0.95\times 1000/fop$$

P1: pre-heat pulse width

P2: interval time (off time)

P3: main heat pulse width

Tdelay: offset time fop: drive frequency

As described in the foregoing, by the drive control means for alternating the advantageous effect and the disadvantageous effect of the driving means, the improper image recording resulting from the offset drive can be suppressed, thus accomplishing the high speed refilling action, and therefore, high speed and high quality image recording are possible.

In addition, the ejection region of the nozzles constituting the blocks, are partly overlapped as in nozzles 1–15 of the first block, nozzles 2–32 of the second block, nozzles 17–47 of the third block, for example. Therefore, the disturbance to the linearity can be reduced.

Embodiment 3

Multi-level (density) printing (including fine interlace)

The color ink jet apparatus of this embodiment is a modification of the apparatus used in Embodiment 2. More particularly, the head cartridge unit and the ink container unit are replaced with a multi-level density head (three level recording using two dye densities). The above-described interlace drive and the even-odd fine alternate drive, are used, by which high quality printing is accomplished. The number of nozzles of the multi-level density head is 32 nozzle (4×8)×4 colors (space between colors=8 nozzle×3), that is, 152 nozzles in total. The head is divided into 9 blocks. The resolution of the head is 360 dpi. The number of heads is two, and use optimized different density inks (two inks for each color, that is, 8 in total). The drive frequency for the recording head is 10.8 KHz.

In this embodiment, the dye densities of the inks are BK-light is 1.0%, BK-dark is 3.5%, C-light is 0.7%, C-dark is 2.5%, M-light is 0.6%, M-dark is 2.5%, Y-light is 0.7%, and Y-dark is 2.0%. They are recorded for one pixel in the order of dark and light.

Figure 23:
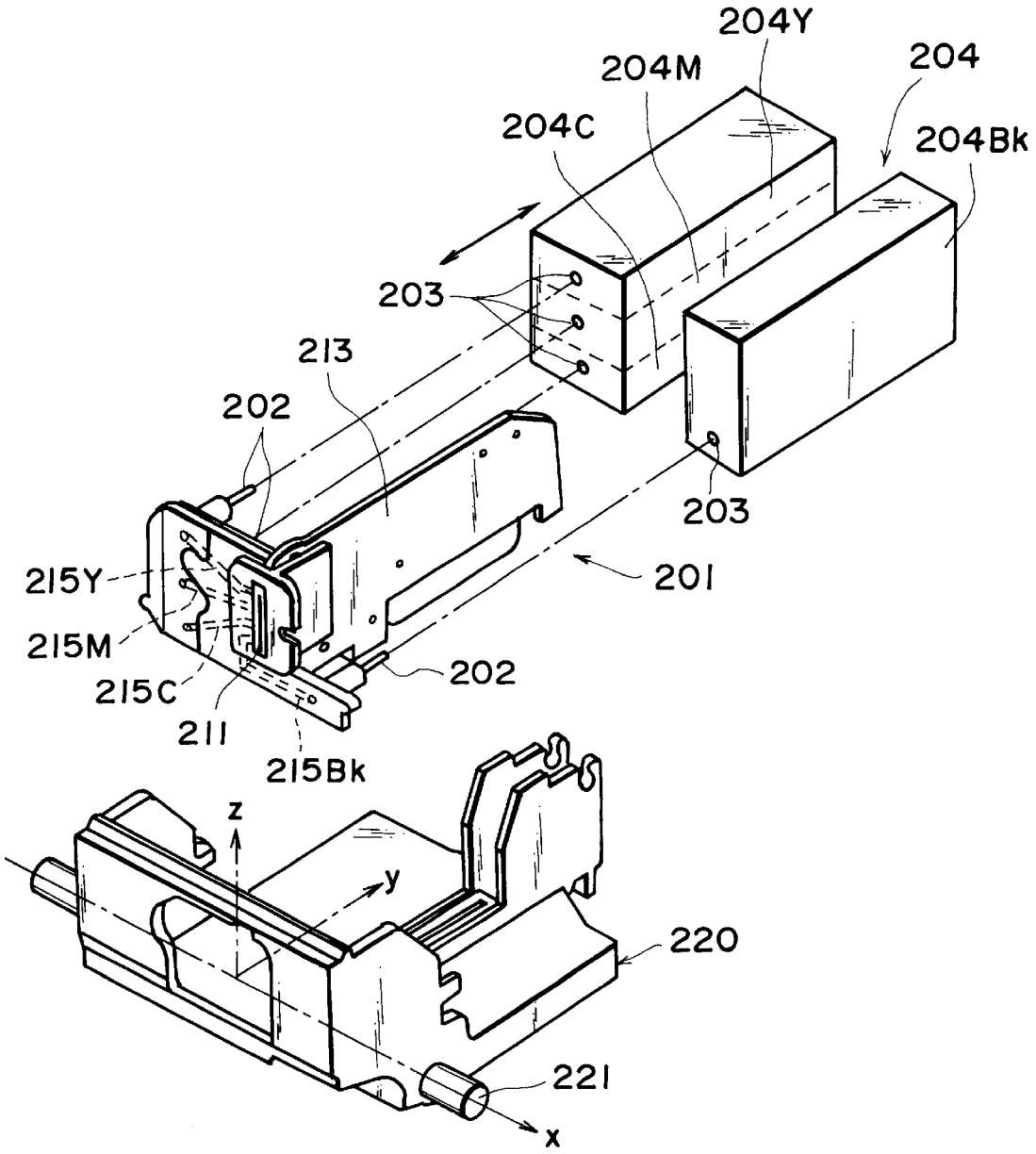
FIG. 23 is a perspective view of a head in Embodiment 3.

FIG. 23 shows the structure of the head. The recording head 201 is capable of printing four colors (BK, C, M and Y) by a single head. The numbers of the nozzles 211 for each color is 32 for BK, 32 for C, 32 for M, and 32 for Y. A connecting portion 202 is used for connection with a supply port 203 of the ink container 204, and the ink is supplied to the recording head through a passage 215. The recording head 201 is mounted on the carriage 220, using the base plate 213. The carriage 220 moves along a guiding shaft 221. The temperature sensor is in the form of a diode sensor, and is disposed at each side of the nozzles and between BK and C (3 in total). The diode sensors monitor an average temperature of the recording head (base temperature TB). The temperature adjacent the nozzles for each color is counted for a dot count for each color provided in the main assembly so that temperatures are independently predicted and controlled.

The description will be made as to the sequential divided interlace drive and fine alternate drive.

As shown in FIG. 24(A)–(C) for the dark and light head drive, the nozzles are grouped into 3 blocks each containing 32 black nozzles, 3 blocks each containing 32 cyan nozzles, 3 blocks each containing magenta 32 nozzles, and 3 blocks each containing yellow 32 nozzles. Since for 8 nozzles between colors (24 nozzles, 2 block in total), there is no time difference, and therefore, they are driven as a unit containing 9 blocks.

First, 8 odd number segments 1, 3, 5, 7, 9, 11, 13 and 15 of the first black block are simultaneously driven by double pulses. Subsequently, 16 even number segments 2, 4, 6, 8, 10, 12, 14, 16, 18, 20, 22, 24, 26, 28, 30 and 32 of the second block are simultaneously driven in the manner that the pulse P12Beven of the double pulse drive of the even number nozzles of the second block is interposed between the pulse P11Bodd of the double pulse drive for the odd number nozzles in the first clock and P31Bodd. At this time, the pulse P12Beven is delayed by approximately 8 μsec from P11Bodd.

Subsequently, 16 odd number segments 17, 19, 21, 23, 25, 27, 29, 31, 33(1C), 35(3C), 37(5C), 39(7C), 41(9C), 43(11C), 45(13C) and 47(15C) of the third block are simultaneously driven as if black and cyan blocks are one block, in the manner that the pulse P13Bodd of the double pulse drive for the odd number nozzles in the third block is interposed between the pulse P12Beven of the double pulse drive for even number nozzles of the second block and the pulse P32Beven. At this time, there exists a delay of approximately 8 gsec between the pulse P13Bodd and P12Beven. In this manner, cyan first—third blocks are driven as if they are black third—fifth blocks.

Subsequently, similarly, 16 even number segments 34(2C), 36(4C), 38(6C), 40(8C), 42(10C), 44(12C), 46(14C), 48(16C), 50(18C), 52(20C), 54(22C), 56(24C), 58(26C), 60(28C), 62(30C) and 64(32C) of the fourth block are simultaneously driven.

Subsequently, as for the fifth block, cyan and magenta blocks are deemed as one block, and 16 odd number nozzles 49(17C), 51(19C), 53(21C), 55(23C), 57(25C), 59(27C), 61(29C), 63(31C), 65(lM), 67(3M), 69(5M), 71(7M), 73(9M), 75(llM), 77(13M) and 79(15M), are simultaneously driven in the manner that P15Bodd of the double pulse drive for the odd number nozzles of the fifth block is interposed between P14Beven of the double pulse drive for the even number of the cyan fourth block and P34Beven. Between P15Bodd and P14Beven, approximately 8 μsec delay can be assumed.

In the similar manner, each of 3 blocks for magenta and yellow colors are deemed as black blocks, so that interlace fine alternate sequential drive on the basis of 9 blocks, is accomplished.

In this manner, first—ninth block are sequentially driven for black to yellow colors. Block intervals TBL (open period for one ejection) is approximately 15 μsec.

Figure 25:
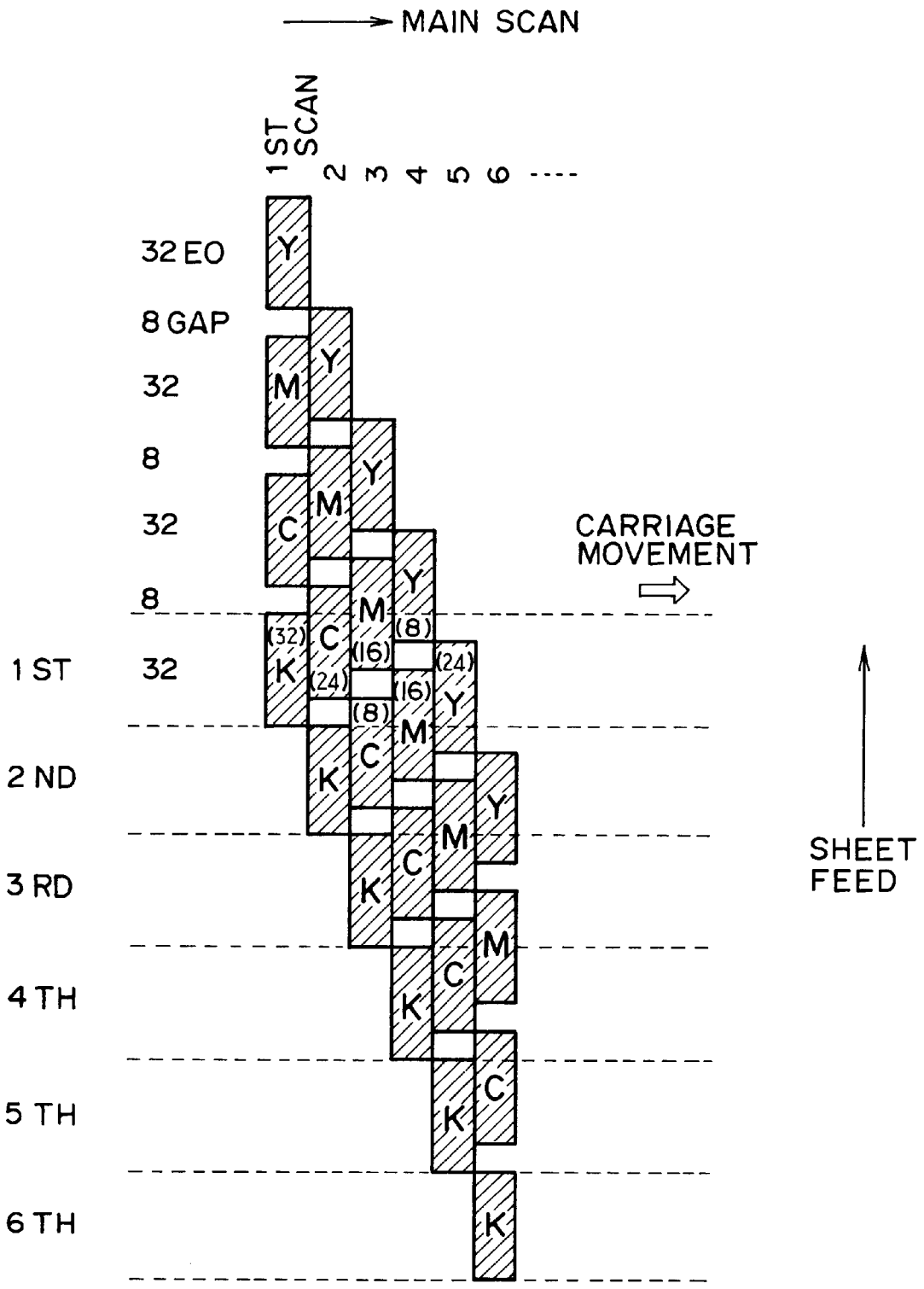
FIG. 25 illustrates recording operation in Embodiment 3.

As for the three density levels for color image, the order of prints by one head is as shown in FIG. 25, when the multi-color integral recording head of this embodiment is used.

That is, in the first scan (path), 32 nozzle printing is effected for black. Then, the sheet is deviated by 32 nozzles, and the second scan is carried out to effect 24 nozzle printing for cyan (32 nozzle printing for the second line for black).

The sheet is deviated by 32 nozzles, and the third scan is carried out to effect 8 nozzle print for cyan (32 nozzle printing for the third line for the black, and 24 nozzle printing for the second line for the cyan).

The sheet is deviated by 32 nozzles, and the fourth scan is carried out to effect 24 nozzle printing for magenta (32 nozzle printing for the fourth line for black, 8 nozzle printing for the third line for cyan, 24 nozzle printing for the second line for cyan).

The sheet is deviated by 32 nozzles, and the fifth scan is carried out to effect 24 nozzle printing for yellow (32 nozzle printing for the fifth line for black, 8 nozzles for the fourth line for cyan, 24 nozzles for the third line for cyan, 8 nozzle printing for the second line for magenta).

The sheet is deviated by 32 nozzles, and the sixth scan is carried out to effect 24 nozzle printing for yellow (32 nozzle printing for the sixth line for black, 8 nozzle printing for the fifth line for cyan, 24 nozzle printing for the fourth line for cyan, 8 nozzle printing for the third line for magenta, 8 nozzle printing of the second line for yellow).

In this manner, dark color printing is carried out for one line with one dye density by six scans.

In the similar manner, four color three level density record is accomplished by sequentially driving the different density (light ink) head.

The description will be made as to the process of the density recording in the case of full-color recording using four color (BK, C, M and Y) each with 3 densities (3 tones).

The order of print is BK (1 (N1), 2 (T1)), C (1 (N1), 2 (T2)), M (1 (N1), 2 (T1)), Y (1 (N1), 2 (T1)), where 1 (N1) indicated dark ink, 2 (T1) is light ink. To reproduced tone levels, the number of droplets per pixel for each color is changed among 0, 1 and 2. Thus, 3 tone levels are reproducible, and the quantity of the ink per pixel for each color is 40 (ng/dot). However, the maximum ink quantity per pixel is limited to 80 (ng/dot) (corresponding to approximately 2.0 color), by image processing (dark-light splitting table, or three level processing or the like).

Figure 26:
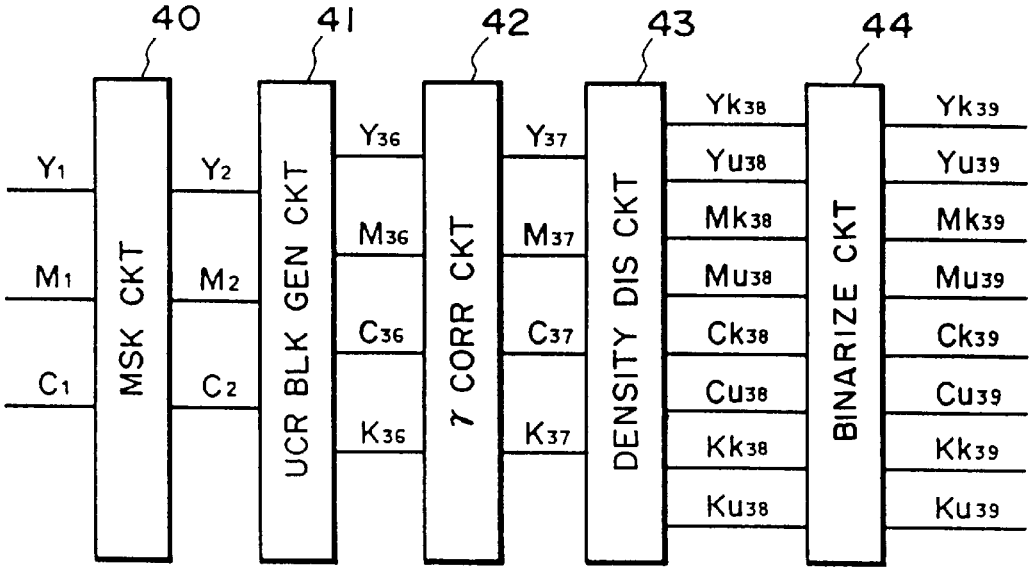
FIG. 26 is a block diagram for image processing structure in Embodiment 3.
Figure 27:
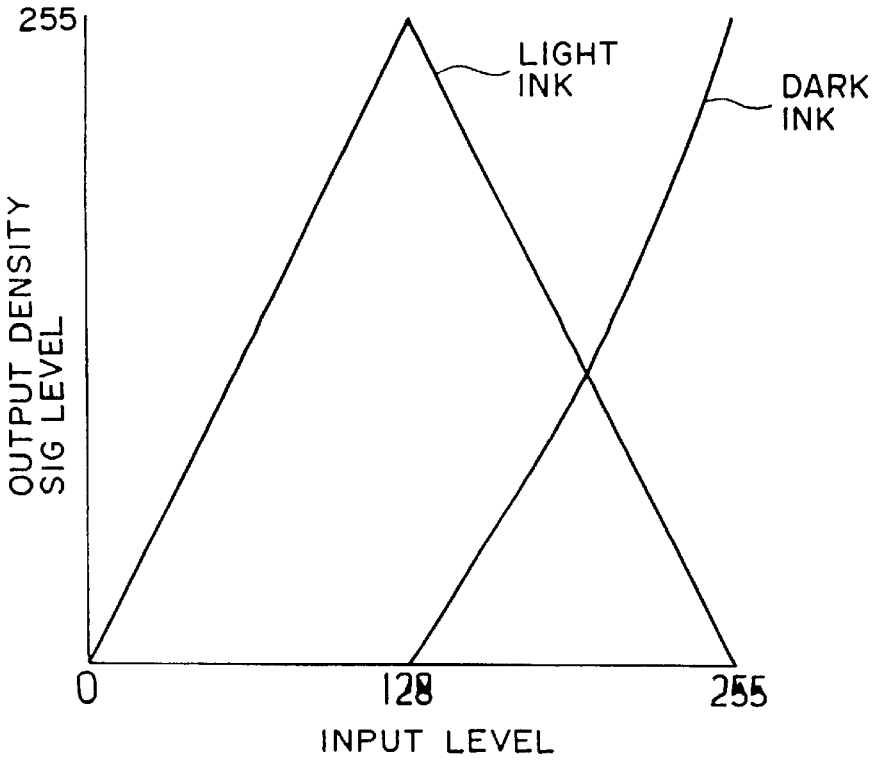
FIG. 27 shows a table for splitting density in Embodiment 3.

In this embodiment, the use is made with an image processing block shown in FIG. 26, and by the density splitting table shown in FIG. 27, the dark ink and the light ink are used while splitting on the basis of the density data of the image. The foregoing description has been made with respect to one color, but the similar printing operation is effected for each of the other color, so that full-colors of high tone reproducibility can be provided without difficulty.

When various images are recorded using the method described above, the manufacturing cost of the main assembly is not increased, and the number of required carriages is not increased, because the three density level recording is possible without increasing the number of heads, as contrasted to the conventional printing using dark ink only. In addition, the number of tone levels can be increased without reduction of the reliability of the head, and therefore, fine high contrast images can be printed without non-uniformity or stripes.

In this embodiment, three level density recording is effected using two heads, but it is a possible alternative that the number of heads is increased, by which four level or five level recording is carried out using 3 or 4 heads. By using interlace drive at this time, good image stability can be provided even if high frequency drive is carried out.

Other Examples

1. Interlace driving method (reduction of power consumption) among cyan, magenta, yellow and black colors:

FIGS. 28(A)–(C) show an example of an interlace driving method for each head when color printing is effected using a plurality of heads. By the interlace drive for each head, the different color heads can be driven substantially simultaneously without increasing the capacity of the power source of the main assembly.

2. Interlace driving method (more than triple pulse) using 3 or more pulses:

The present invention is applicable for an interlace drive not less than 3 pulses.

Figure 29:
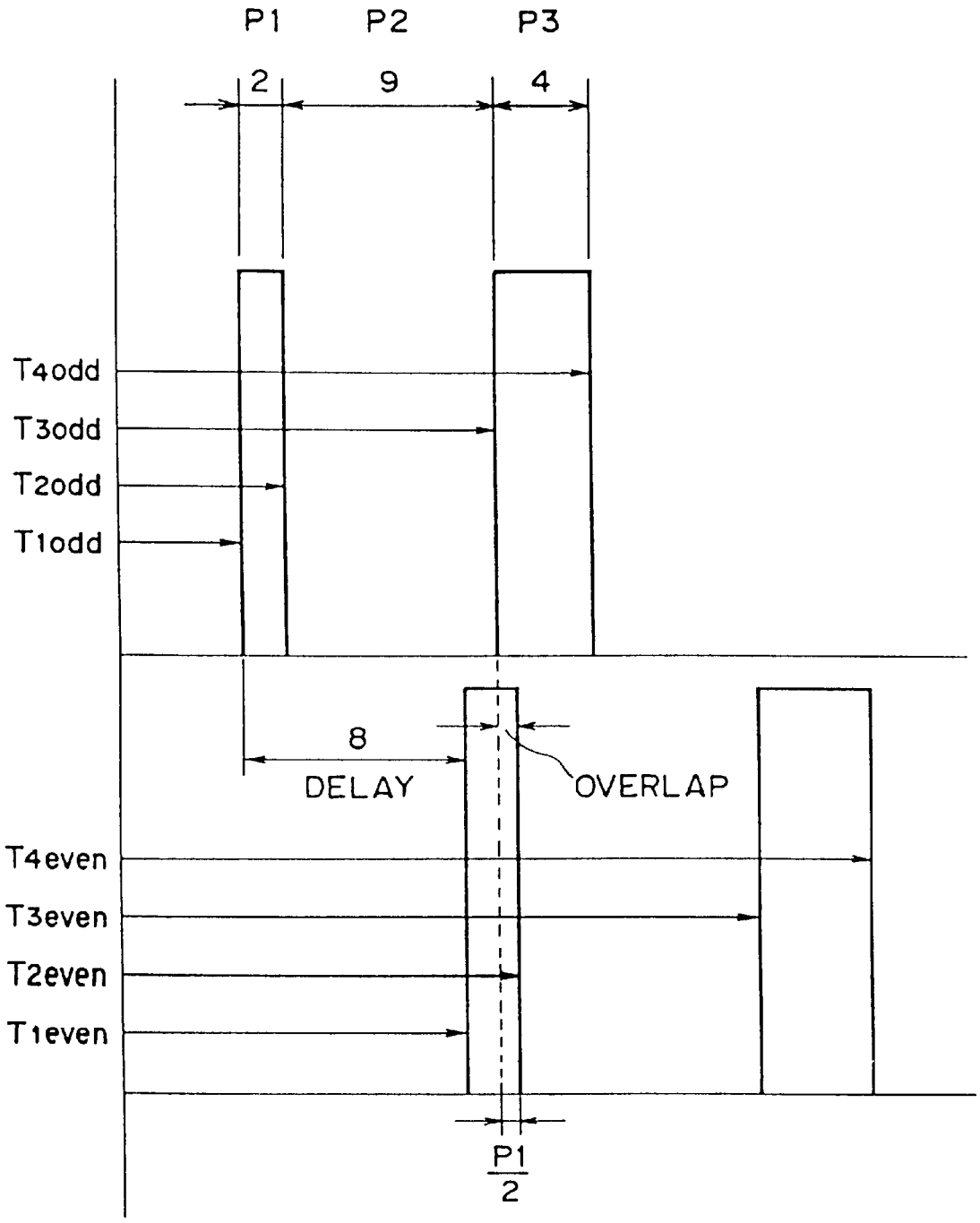
FIG. 29 illustrate a drive waveform of an overlapped interlace according to a further embodiment of the present invention.
Figure 30:
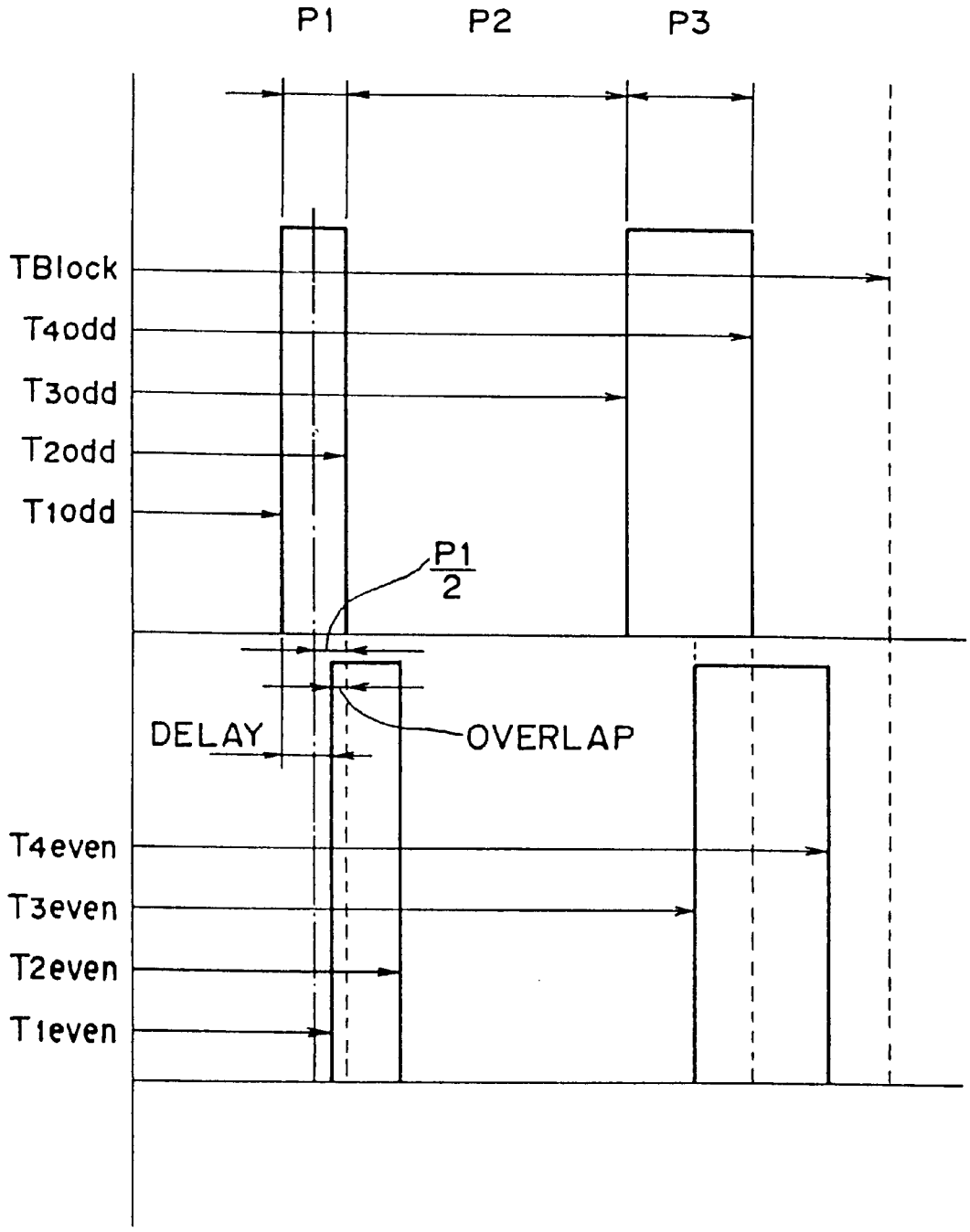
FIG. 30 illustrates a drive waveform of an interlace overlapping according to a further embodiment of the present invention.

3. Overlapping interlace drive (overlapping of pulses):

Referring to FIGS. 29 and 30, the description will be made as to when pulse overlapping occurs in the interlace drive.

FIG. 29 shows an example in which the overlapping between the pulse widths P1 and P3 are permitted to the extent of P1/2, under the condition that $P2<Tdelay<P1/2+P2$. By doing so, the offset time Tdelay is made variable. FIG. 30 shows an example in which the overlapping between P1 and P1 (Poverlap) is permitted to the extent of P1/2 under the condition that $P1/2<Tdelay<P2$. By doing so, the offset time Tdelay can be made variable.

By combining them, the condition for Tdelay is eased to the extent of $P1/2<Tdelay<P1/2+P2$. In these cases, the influence of the variation of the power supply for the overlapping of the pulses is concerned, and therefore, it is desirable that the influence of the overlapped portions are investigated, and the pulse width is corrected.

Figure 31:
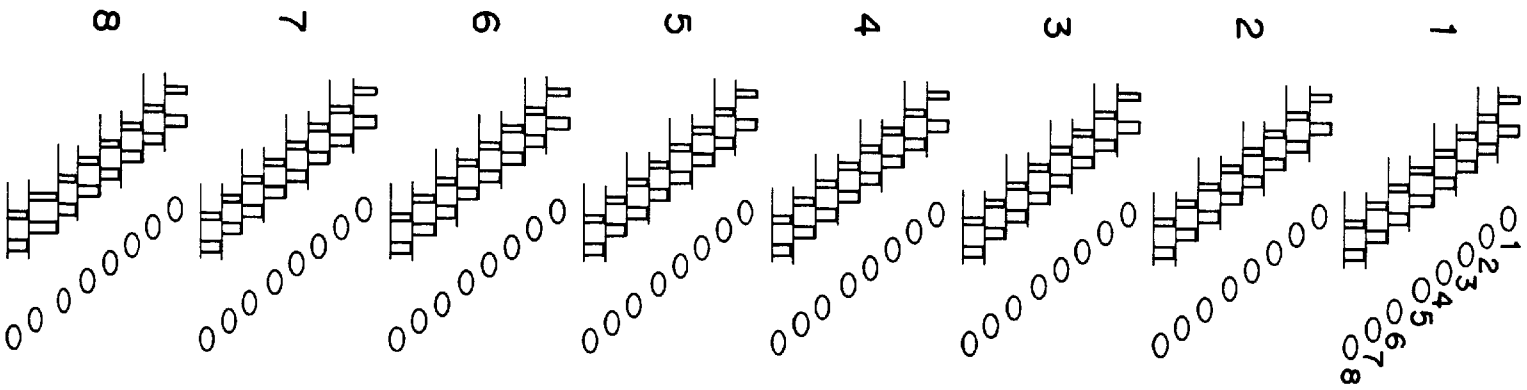
FIG. 31 illustrates a dispersion type interlace drive waveform according to a further embodiment of the present invention.

4. Dispersed interlace drive:

FIG. 31 shows an example in which the interlace drive is used for a dispersion type driving method. The dispersion type drive is a method in which the nozzles for every other plurality of nozzles are simultaneously driven. In this example, the nozzles are simultaneously driven for every other 8 nozzles. By combining the dispersion type drive with the interlace drive, the liquid crosstalk influence is reduced. As shown here, the interlace drive is possible irrespective of the driving system.

Figure 34:
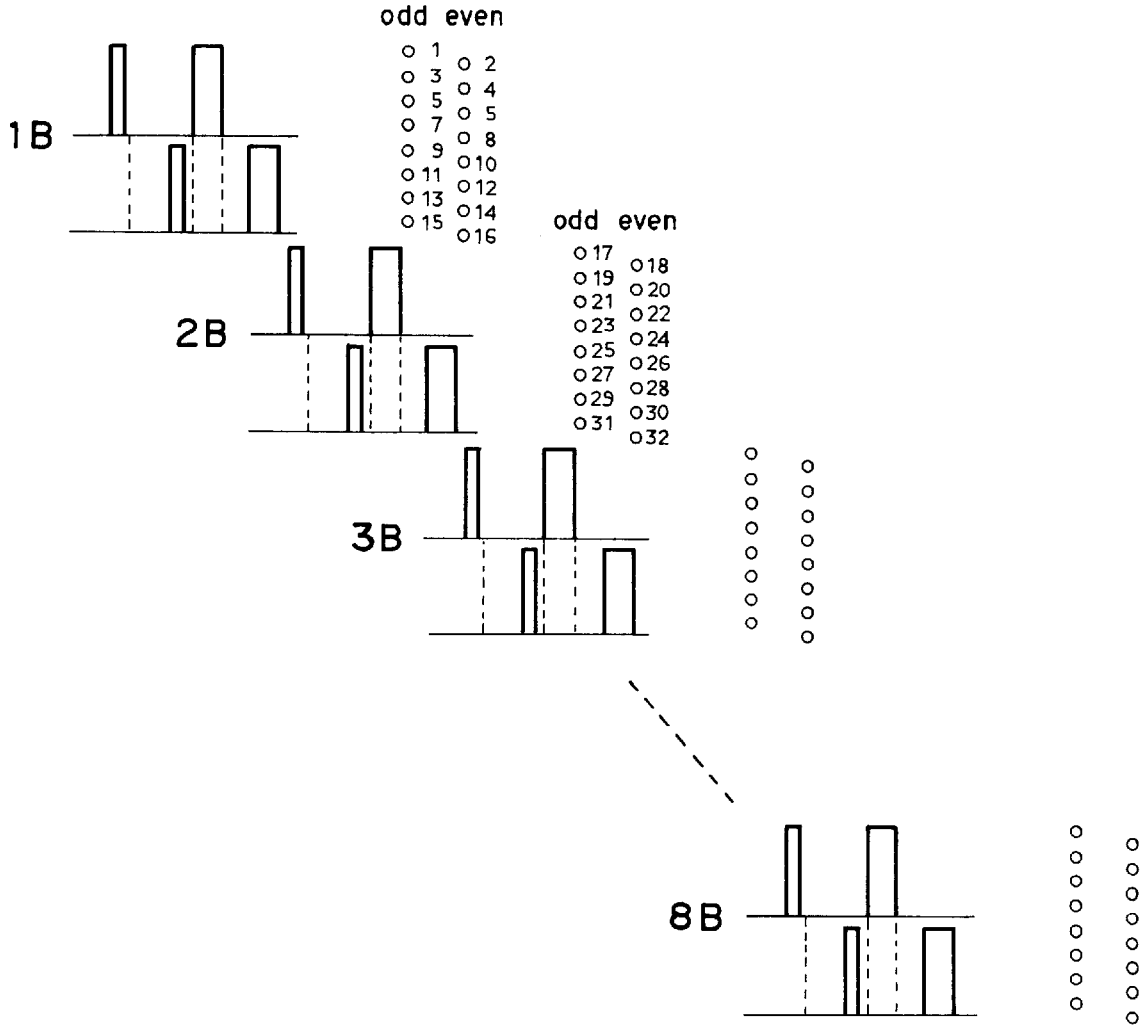
FIG. 34 illustrates an interlace drive in a block, according to a further embodiment of the present invention.

5. In-block interlace drive:

FIG. 34 shows an example in which the interlace drive is used only for the drive within the block. In FIG. 18, the interlace drive is carried out not only within the block but among the blocks, for example, the even number nozzles in the first block 1B and the odd number nozzles in the second block 2B. The inblock interlace drive means the interlace drive only within the block.

The in-block interlace drive, $P1+P3<Tdelay<P2$ is satisfied. Therefore, the control condition is less strict than in the inter-block interlace drive.

According to the above embodiments, the maximum offset drive is possible by using the interlace drive but not at the cost of the control width (time period between blocks) of the multiple pulses. In addition, the stabilizations of the ejection amount and the ejection speed provided by the ejection property control by the PWM control, can be accomplished. Therefore, further record speed increase and high image quality irrespective of the ambient condition, can be accomplished.

The present invention is usable with any ink jet apparatus, such as those using an electromechanical converter such as piezoelectric element, but is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating porion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the mountable recording head, it may be single corresponding to a single color ink, or may be plural corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquified at the room temperature. Since the ink is controlled within the temperature not lower than 30° C. and not higher than 70° C. to stabilize the viscosity of the ink to provide the stabilized ejection in the usual recording apparatus of this type, the ink may be such that it is liquid within the temperature range when the recording signal in the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method comprising:

providing an ink jet head having a plurality of ink ejection outlets through which ink is ejected by a plurality of ejection energy means for applying ejection energy, each ejection on energy means corresponding to an ink ejection outlet;

grouping the ejection energy means into first and second groups;

supplying a first driving signal, having a first phase, to the first group of the ejection energy means, wherein the first driving signal is variable and comprises, for each one ejection of the ink, at least a first signal period P1 for heating the ink prior to each one ejection, a second signal period P3 for generating a bubble for ejecting the ink using heat subsequent to each first signal period, and a rest period therebetween; and supplying a second driving signal, having a second phase which is different from the first phase, to the second group of the ejection energy means, wherein the second driving signal is variable and comprises, for each one ejection of the ink, a first signal period for heating the ink prior to each ejection, a second signal period for generating a bubble for ejecting the ink using heat subsequent to each first signal period, and a rest period P2 therebetween, even when the first and second driving signals are varied, the first signal period P1 of the first phase, the third signal period P3 of the first phase and the rest period P2 of the second chase satisfy P1+P3<P2.

2. A method according to claim 1, wherein the rest period of the first driving signal and the rest period of the second driving signal are provided adjacent first signal periods of the first driving signal and the second driving signal, respectively, in which ejection energy applied by the ejection energy means is most efficiently dispersed to the ink before the second signal periods of the first driving signal and the second driving signal respectively, are supplied.

3. A method according to claim 1, wherein the first signal periods of the first driving signal and the second driving signal are variable.

4. A method according to claim 1, wherein the recording head ejects ink using thermal energy generated by the first and second driving signals.

5. A method according to claim 1, wherein the ejection energy means are grouped into a plurality of blocks of ink ejection outlets so that ejection regions thereof are partly overlapped, wherein the first driving signal and the second driving signal are supplied to the ink ejection outlets in the blocks in such an order that periods of ejecting ink from the ejection regions are partly overlapped.

6. An ink jet recording method according to claim 1, wherein the first signal period and the rest period are variable.

7. An ink jet recording method comprising:

providing a recording head having a plurality of ink ejecting nozzles each having an ink ejection outlet, with the plurality of nozzles grouped into a number (i) of blocks of nozzles;

supplying driving signals in a time-shared manner to the nozzles in each nozzle block, wherein each driving signal is variable and comprises, for each one ejection of the ink, a first signal period P1 for heating the ink, a second signal period P3 for generating a bubble for ejecting the ink using heat, and a rest period P2 therebetween, for each driving of the nozzle blocks, wherein a first signal period P1 of a second block of nozzles is in a rest period P2 of a first block of nozzles after a first signal period P1 of the first block, a second signal period P3 of the first block is in a rest period P2 of a third block of nozzles, and these operations are repeated up to an i-th numbered block, and even if the driving signals are varied, P2>P1+P3 is satisfied.

8. A method according to claim 6, wherein the recording head ejects ink through the ink ejection outlets using thermal energy generated by the driving signals supplied to the nozzles.

9. An ink jet recording method according to claim 7, wherein the first signal period P1 and the rest period P2 are variable.

10. An ink jet recording method comprising:

providing a recording head having a plurality of ink ejecting nozzles each having an ink ejection outlet, with the plurality of nozzles grouped into a number (i) of blocks of nozzles;

supplying driving signals in a time-shared manner to the nozzles in each nozzle block, wherein each driving signal comprises a first signal period P1 for heating the ink, a second signal period P3 for generating a bubble for ejecting the ink using heat, and a rest period P2 therebetween, for each driving of the nozzle blocks, wherein a first signal period P1 of a second block of nozzles is in a rest period P2 of a first block after a first signal period PI of the first block, a second signal period P3 of the first block is in a rest period P2 of the second block, the first signal period P1 of a third block is in a rest period P2 of a second block, a second signal period P3 of a second block is in a rest period P2 of the third block, these operations are repeated up to an i-th numbered block and the following is satisfied:

$$P1+P3<h<P2,$$

where h is a phase difference between successive driving signals.

11. An ink jet recording method in which a driving signal comprises at least a first pulse for heating ink, a second pulse for generating a bubble for ejecting the ink using heat and a rest period therebetween, to effect each one ejection of ink, a plurality of the driving signals are supplied to ejection parts of a recording head in a time-shared manner, and each driving signal is for one ejection of the ink, said method comprising:

supplying a first pulse of a first driving signal;

supplying a first pulse of a second driving signal in a rest period of the first driving signal; and supplying a second pulse of the first driving signal in a rest period of the second driving signal, and thereafter, supplying a second pulse of the second driving signal, wherein the driving signals are variable, and even if the driving signals are varied, said first and second driving signals satisfy a relation that the rest period is longer then a sum of the first and second pulses in said supplying steps.

12. A method according to claim 11, wherein the recording head ejects ink using thermal energy generated by the driving signals supplied to the ejection parts.

13. An ink jet recording method according to claim 11, wherein the first signal period and the rest period are variable.

14. An ink jet recording apparatus comprising:

a recording head having at least a first group of ejection parts and a second group of ejection parts, the first group and the second group being independently drivable; and driving signal supplying means for supplying driving signals to the first group and to the second group, in a time-shared manner, each driving signal is variable and comprising, for each one ejection of the ink, at least a first signal period P1 for heating ink, a second signal period P2 for generating a bubble for ejecting the ink using heat, and a rest period P3 therebetween, to effect each one ejection of the ink, wherein the first signal period of the driving signal for the second group is in a rest period of the driving signal for the first group, and even if the driving signals are varied, P2>P1+P3 is satisfied.

15. An apparatus according to claim 14, further comprising a carriage for carrying said recording head.

16. An apparatus according to claim 14, further comprising feeding means for feeding a recording material which is subjected to a recording operation of said recording head.

17. An apparatus according to claim 14, wherein said recording apparatus is used in a copying machine.

18. An apparatus according to claim 14, wherein said recording apparatus is used in a facsimile machine.

19. An apparatus according to claim 14, wherein said recording apparatus constitutes an output terminal of a computer.

20. An apparatus according to claim 14, wherein said recording head ejects ink using thermal energy generated by the driving signals supplied to the first group of ejection parts and the second group of ejection parts.

21. An ink jet recording apparatus according to claim 14, wherein the first signal period and the rest period are variable.

22. An ink jet recording apparatus comprising:

a recording head having at least a first group of ejection parts and a second group of ejection parts, the first group and the second group being independently drivable; and driving signal supplying means for supplying a first driving signal to the first group and a second driving signal to the second group, in a time-shared manner, the first and the second driving signals each comprising, for each one ejection of the ink, at least a first signal period for heating the ink, a second signal period for generating a bubble for ejecting the ink using heat and a rest period therebetween, wherein the second signal period of the second driving signal for the second group and a first signal period of a subsequent second driving signal are in a rest period of a subsequent first driving signal for the first group, and the second signal period of the first driving signal for the first group and a first signal period of a subsequent first driving signal are in the rest period of the second driving signal for the second group.

23. An apparatus according to claim 22, further comprising a carriage for carrying said recording head.

24. An apparatus according to claim 22, further comprising feeding means for feeding a recording material which is subjected to a recording operation of said recording head.

25. An apparatus according to claim 22, wherein said recording apparatus is used in a copying machine.

26. An apparatus according to claim 22, wherein said recording apparatus is used in a facsimile machine.

27. An apparatus according to claim 22, wherein said recording apparatus constitutes an output terminal of a computer.

28. An apparatus according to claim 22, wherein said recording head ejects ink using thermal energy generated by the first and second driving signals.

29. An ink jet recording apparatus according to claim 22, wherein the first signal period and the rest period are variable.

* * * * *

UNITED STATES PATENT AND TRADEMARK OFFICE

CERTIFICATE OF CORRECTION

PATENT NO. : 6,296,340 B1 
DATED : October 2, 2001
INVENTOR(S) : Hiroshi Tajika et al.

It is certified that error appears in the above-identified patent and that said Letters Patent is hereby corrected as shown below:

Title page,
Item [56], U.S. PATENT DOCUMENTS, "5,172,134 12/1992 Shida et al." should read -- 5,172,134 12/1992 Kishida et al. --.

Drawings,
SHEET 13, FIG. 13(B), "TELLE RABLE" should read -- TOLERABLE --.
SHEET 14, FIG. 14(B), "TELLE RABLE" should read -- TOLERABLE --.

Column 1,
Line 53, "Particularly when," should read -- Particularly, when --.

Column 3,
Line 40, "i-the" should read -- i-th --; and
Line 51, "drive" should read -- driving --.

Column 5,
Line 23, "illustrate" should read -- illustrates --;
Line 55, "FIGS. 1-5," should read -- FIGS. 1-5 --,
and "a" should read -- an --.

Column 6,
Line 26, "JIC" should read -- IJC --;
Line 62, "interface 100" should read -- interface 10 --;
Line 64, "array 104" should read -- array 14 --, "MPU 101" should read -- MPU 11 --,
and "driver 106" should read -- driver 16 --;
Line 65, "driver 107" should read -- driver 17 --; and
Line 67, "105" should read -- 15 --.

Column 7,
Line 2, "array 104." should read -- array 14. --.;
Line 10, "election" should read -- ejection --;
Line 16, "end" should read -- ends --;
Line 18, "heatEN-B" should read -- HeatEN-B --; and
Line 23, "counter 144α" should read -- counter 144A --.

UNITED STATES PATENT AND TRADEMARK OFFICE

CERTIFICATE OF CORRECTION

PATENT NO. : 6,296,340 B1
DATED : October 2, 2001
INVENTOR(S) : Hiroshi Tajika et al.

It is certified that error appears in the above-identified patent and that said Letters Patent is hereby corrected as shown below:

Column 8,
Line 33, “period” should read -- periods --.

Column 9,
Line 21, “inventors,” should read -- inventors --; and
Line 59, “above described” should read -- above-described --.

Column 10,
Line 5, “FIG. 12,” should read -- FIG. 12B, --; and
Line 47, “heater Hi” should read -- heater HI --.

Column 11,
Line 44, “8 block” should read -- 8 blocks --.

Column 12,
Line 57, “blade” should read -- blades --.

Column 13,
Line 12, “switch 530” should read -- switch 830 --;
Line 22, “array 104.” should read -- array 14. --;
Line 30, “election” should read -- ejection --; and
Line 37, “end” should read -- ends --.

Column 14,
Line 2, “diodes,” should read -- diodes --;
Line 50, “8 gsec” should read -- 8 $\mu$sec --; and
Line 64, “52” (second occurrence) should read -- 62 --.

Column 16,
Line 67, “print” should read -- printing --.

Column 17,
Line 29, “indicated” should read -- indicates --, and “reproduced” should read -- reproduce --; and
Line 43, “color,” should read -- colors, --.

Column 18,
Line 43, “inblock” should read -- in-block --.

Column 19,
Line 11, “porion” should read -- portion --.

UNITED STATES PATENT AND TRADEMARK OFFICE

CERTIFICATE OF CORRECTION

PATENT NO. : 6,296,340 B1
DATED : October 2, 2001
INVENTOR(S) : Hiroshi Tajika et al.

It is certified that error appears in the above-identified patent and that said Letters Patent is hereby corrected as shown below:

Column 20,
Line 48, “on” should be deleted; and
Line 59, “rest period” should read -- rest period P2 --.

Column 21,
Line 13, “signal” should read -- signal, --; and
Line 34, “nozzles;” should read -- nozzles; and --.

Column 22,
Line 30, “then” should read -- than --.

Signed and Sealed this

Second Day of July, 2002

*Attest:*

*Attesting Officer*

JAMES E. ROGAN
*Director of the United States Patent and Trademark Office*